US012207682B2

(12) United States Patent
Fisten

(10) Patent No.: US 12,207,682 B2
(45) Date of Patent: Jan. 28, 2025

(54) CIGAR HOLE PUNCHES

(71) Applicant: VPR Brands, LP, Ft Lauderdale, FL (US)

(72) Inventor: Douglas Fisten, Miami, FL (US)

(73) Assignee: VPR Brands, LP, Sunrise, FL (US)

( * ) Notice: Subject to any disclaimer, the term of this patent is extended or adjusted under 35 U.S.C. 154(b) by 445 days.

(21) Appl. No.: 17/698,713

(22) Filed: Mar. 18, 2022

(65) Prior Publication Data

US 2023/0129470 A1 Apr. 27, 2023

(30) Foreign Application Priority Data

Oct. 25, 2021 (CN) ..... 202122574303.2

(51) Int. Cl.
*A24F 13/26* (2006.01)

(52) U.S. Cl.
CPC ..... *A24F 13/26* (2013.01)

(58) Field of Classification Search
CPC ..... A24F 13/24; A24F 13/26
See application file for complete search history.

(56) References Cited

U.S. PATENT DOCUMENTS 6,257,873 B1 * 7/2001 Song ..... A24F 13/26 131/249
2020/0352226 A1 * 11/2020 Zabaglo ..... A24F 13/26
2020/0352227 A1 * 11/2020 Zabaglo ..... B26F 1/32

* cited by examiner

*Primary Examiner* — Eric Yaary
(74) *Attorney, Agent, or Firm* — Hanley, Flight & Zimmerman, LLC

(57) ABSTRACT

Cigar hole punches are disclosed herein. An example cigar hole punch includes a first body having an end with an opening, a second body coupled to the first body, a cutting blade at least partially disposed in the first body, a positioning pin at least partially disposed in the first body, and an actuator to move the cutting blade and the positioning pin into and out of the opening in response to relative movement between the first and second bodies.

13 Claims, 14 Drawing Sheets

CIGAR HOLE PUNCHES

RELATED APPLICATION

This patent claims priority to Chinese Patent Application No. 202122574303.2, filed Oct. 25, 2021, which is hereby incorporated by reference in its entirety.

FIELD OF THE DISCLOSURE

This disclosure relates generally to smoking accessories and, more particularly, to cigar hole punches.

BACKGROUND

Cigars are made of leaves of tobacco that are usually rolled into cylindrical shapes. Cigars come in many shapes, such as Parejo and Figurado. All premium cigars no matter the shape have a closed cap or head to help maintain the flavor. The other end referred to as the "foot" of the cigar is cut during the manufacturing process and open to air flow. The cap or head of the cigar must be cut or punched before the cigar is smoked. A cigar hole punch is a bladed device for making a hole or opening in the cap or head of the cigar so that a user can draw air through the cigar and thus "smoke" the cigar.

BRIEF DESCRIPTION OF THE DRAWINGS

FIG. 1 shows an example cutting blade and an example positioning pin of the example cigar hole punch in a retracted position.

Figure 1:
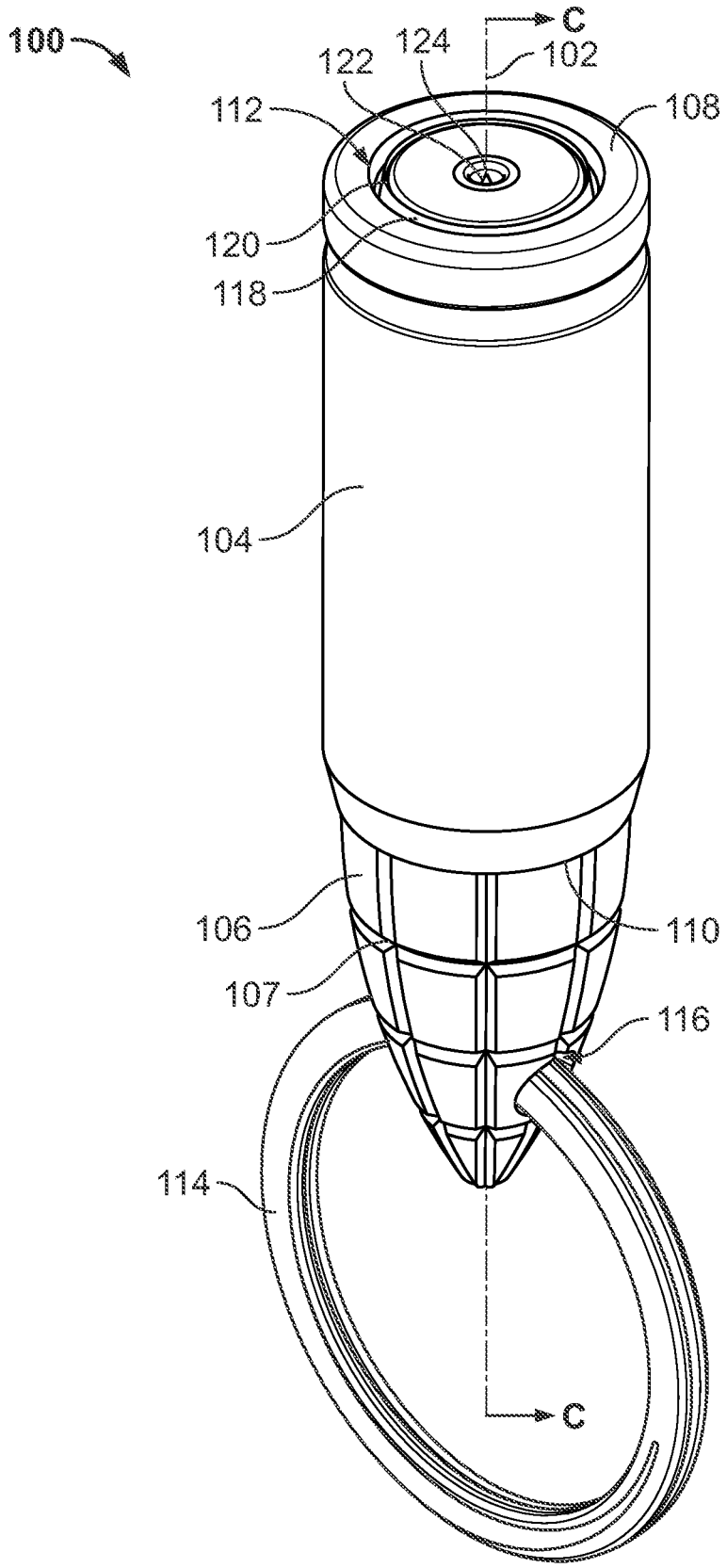
FIG. 1 is a perspective view of an example cigar hole punch constructed in accordance with the teachings of this disclosure.

The figures are not necessarily to scale. Instead, the thickness of the layers or regions may be enlarged in the drawings. Although the figures show layers and regions with clean lines and boundaries, some or all of these lines and/or boundaries may be idealized. In reality, the boundaries and/or lines may be unobservable, blended, and/or irregular. In general, the same reference numbers will be used throughout the drawing(s) and accompanying written description to refer to the same or like parts.

As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name.

DETAILED DESCRIPTION

Disclosed herein are example hole punches, referred to herein as cigar hole punches, that include example cutting means such as, for example, a circular cutting blade. The circular cutting blade can be used to cut and/or punch a hole in the closed end (e.g., the head or cap) of a cigar, which enables air to flow through the cigar for a person to draw on or smoke the cigar. The example cigar hole punches disclosed herein can also be used for cutting other smoking products, such as cigarettes. Also, the examples disclosed herein can be used for cutting and/or punching holes in other objects.

Known cigar hole punches include a circular cutting blade that can be pushed and twisted onto an end of a cigar to cut a hole in the end of the cigar. However, when pushing the cutting blade into the end of the cigar, the cutting blade often shifts or moves laterally. This results in a crooked hole and/or overly large hole. This can also cause the tobacco leaves to crack and flake around the hole. This results in a messy hole or opening, and the cracked or flaking tobacco leaves can be inhaled into the user's mouth, which is undesirable. Also, users may not know how deep to punch the hole, which can lead to inconsistent hole depth. Therefore, users may have to punch the hole multiple times to obtain the correct or desired depth. Further, known cigar hole punches do not consistently remove the disc or cut section from the end of the cigar. As such, the user has to manually dig or scrape the end of the cigar to remove the disc to reveal the opening.

Disclosed herein are example cigar hole punches that include an example cutting blade and example positioning pin. The positioning pin is disposed in a center of (e.g., is coaxial with) the cutting blade. The positioning pin extends further outward than the cutting blade. In some examples, the positioning pin has a sharp or pointed tip. When the cigar hole punch is moved toward the end of the cigar, the positioning pin stabs or pierces the end of the cigar first before the cutting blade. This helps stabilize the cigar hole punch. The cigar hole punch can then be moved further toward the end of the cigar and so that the cutting blade engages the end of the cigar. The cigar hole punch can be pushed and twisted so the cutting blade cuts a hole in the end of the end of the cigar. The cigar hole punch can be pulled away to remove the material that has been cut, thereby leaving a hole in the end of the cigar. The positioning pin facilitates alignment of the cutting blade with the end of the cigar. In addition, the positioning pin, once inserted into the end of the cigar, limits or prevents side-to-side movement. This helps stabilize the cutting process. As such, the cutting blade can be moved straight into the end of the cigar without sliding laterally on the end of the cigar. This prevents or reduces cracking and flaking of the tobacco leaves around the holes and thereby results in a cleaner, more accurate hole. Said another way, the positioning pin helps line up the cutting blade in the center of the end of the cigar so the user does not cut the top part of the cigar to risk cracking the cigar, thereby helping to make an effective punch. Further, the positioning pin helps remove the disc that has been cut to leave a clean opening in the end of the cigar. For example, the disc may stick to the positioning pin (e.g., due to friction) and/or become wedged between the positioning pin and the cutting blade. As such, when the user pulls the cigar punch away from the end of the cigar, the complete disc is removed from the end of the cigar without disrupting the roll of the cigar. This helps to consistently create a clean, smooth opening and remove the disc that has been cut.

In some examples disclosed herein, the cigar hole punch includes a body and an actuation mechanism that can be used to retract or deploy the cutting blade and the positioning pin relative to the body. For example, the cutting blade and the positioning pin can be retracted into the body when the cigar hole punch is not being used to prevent accidental poking. When the cigar hole punch is ready to be used, a user can actuate the cigar hole punch to move the cutting blade and the positioning pin to a deployed position, in which the cutting blade and the positioning pin are exposed.

In some examples disclosed herein, the cutting blade and the positioning pin are moved between the retracted position and the deployed position in response to relative movement, such as a twisting or a rotating motion. For example, the cigar hole punch can include a first body and a second body that are rotatably coupled. In some examples, the first and second bodies are cylindrical shaped, which enables the first and second bodies to rotate or twist relative to each other. The first body has a first end and a second end. The first end has an opening. The second body extends outward from the second end of the first body. The cutting blade and the positioning pin are at least partially disposed in the first body. The cutting blade and the positioning pin are moveable into and out of the first body through the opening in the first end. The cigar hole punch includes an actuation mechanism in the first body that moves the cutting blade and the positioning pin in response to relative rotation of the first and second bodies. In the retracted position, the cutting blade and the positioning pin are aligned with or disposed below the first end, to prevent accidental poking. When the first and second bodies are twisted or rotated relative to each other, the actuation mechanism moves the cutting blade and the positioning pin outward from the first end of the first body. For example, the user can hold the second body with one hand, and can rotate the first body using the user's other hand, or vice versa. Rotating the first body relative to the second body in one direction causes the cutting blade and the positioning pin to extend outward from the first end of the first body, and rotating the first body relative to the second body in the opposite direction causes the cutting blade and the positioning pin to retract back into the first end of the first body. Either body can be rotated relative to the other, or both bodies can be rotated (in opposite directions) at the same time. When the cutting blade and the positioning pin are deployed the positioning pin moves outward from the first end at a faster rate than the cutting blade. As such, the tip of the positioning pin is outward or beyond the edge of the cutting blade.

In some examples, the cutting blade and the positioning pin are moveable between the retracted position and a fully deployed position. In some examples, the fully deployed position corresponds to a certain length of the cutting blade that is exposed to create a desired hole depth in the cigar. The cigar hold punch can be pushed onto the end of the cigar until the end of the cigar engages the first end of the first body. This results in a consistent depth hole every time. The cutting blade and the positioning pin can also be moved to any depth between the retracted position and used to cut a hole in the cigar. In some examples, the actuation mechanism creates a small amount of friction to temporarily hold the bodies at one or more predefined positions between the retracted position and the fully deployed position. Therefore, the user can set the cutting depth to one or more predefined depths based on their desired preference.

Turning now to the figures, FIG. 1 is a perspective view of an example cigar hole punch 100 constructed in accordance with the teachings of this disclosure. The example cigar hole punch 100 can be used to cut and/or punch a hole (e.g., a circular hole) in a cigar or other smoking implement. In this example, the cigar hole punch 100 is generally cylindrical shaped with a conical end. The cigar hole punch 100 has a central or longitudinal axis 102. In this example, the central axis 102 extends through a center of the cylindrical and conical portions of the cigar hole punch 100. In some examples, the cigar hole punch 100 has a fully cylindrical shape. In other examples, the cigar hole punch 100 can be shaped differently.

In the illustrated example, the cigar hole punch 100 includes a first body 104 and a second body 106 that is coupled to the first body 104. The first and second bodies 104, 106 may also be referred to as casings, housings, or portions. In some examples, the first body 104 can be referred to as a punch head and the second body 106 can be referred to as a punch body. The first and second bodies 104, 106 are coaxial. In the illustrated example, the first body 104 is cylindrical shaped and the second body 106 is conical shaped. As such, in this example, the cigar hole punch 100 is shaped as bullet, which may be aesthetically appealing to users. However, in other examples the second body 106 may also be cylindrical shaped similar to the first body 104. In still other examples, the first or second bodies 104, 106 may be shaped differentially (e.g., the second body 106 may be dome shaped). In some examples, the first and second bodies 104, 106 are constructed of metal (e.g., steel, aluminum, etc.). In other examples, the first and/or second bodies 104, 106 can be constructed of other materials (e.g., plastic) or combination of materials. In the illustrated example, an outer surface of the second body 106 has a pattern 107 (e.g., grooves, ridges, knurling, etc.) to provide additional grip when holding the cigar hole punch 100.

The first and second bodies 104, 106 are rotatably coupled. In other words, the first and second bodies 104, 106 can rotate or twist relative to each other about the central axis 102. However, the first and second bodies 104, 106 do not move linearly (along the central axis 102) relative to each other. In the illustrated example, the first body 104 has a first end 108 and a second end 110 opposite the first end 108. In this example, the second body 106 is partially disposed in the first body 104 and extends outward from the second end 110 of the first body 104. The first end 108 has an opening 112. As disclosed in further detail herein, relative movement (e.g., rotation) of the first and second bodies 104, 106 causes a cutting blade and a positioning pin to move outward from or into the first end 108 through the opening 112.

Many of the examples disclosed herein are described in connection with rotating the first body 104 relative to the second body 106. For example, a user may hold the second body 106 stationary and rotate/twist the first body 104 relative to the second body 106, which moves the cutting blade and positioning pin into or out of the first end 108 of the first body 104. However, it is understood that the same result may occur if the second body 106 is rotated relative to the first body 104. For example, a user may hold the first body 104 stationary and may rotate/twist the second body 106 relative to the first body 104. In another example, a user may rotate both the first and second bodies 104, 106 in opposite directions at the same time, such as by rotating/twisting the first body 104 in a clockwise direction and rotating/twisting the second body 106 in a counter-clockwise direction, or vice versa.

The cigar hole punch 100 may be sized to fit in a pocket of a user. In the illustrated example, the cigar hole punch 100 includes a key ring 114 (e.g., a split key ring). The key ring 114 provides a convenient way for a user to carry and hold the cigar hole punch 100. Further, the key ring 114 enables the cigar hole punch 100 to be carried on a user's key set (e.g., with one or more keys). In this example, the key ring 114 is coupled to the second body 106. The second body 106 has an opening 116, and the key ring 114 is inserted through the opening 116. In other examples, the key ring 114 can be coupled to the cigar hole punch 100 at another location. In other examples, the cigar hole punch 100 may not include a key ring.

In the illustrated example, the cigar hole punch 100 includes a circular cutting blade 118, referred to herein as the cutting blade 118. The cutting blade 118 can also be referred to as an opening member or punch member. In some examples, the cutting blade 118 is metal, such as steel and/or aluminum. In other examples, the cutting blade 118 can be constructed of another material. The cutting blade 118 has a cutting edge 120. The cutting blade 118 is at least partially disposed in the first body 104. In the position in shown in FIG. 1, the cutting blade 118 is entirely disposed in the first body 104. The cutting blade 118 is moveable into and out of the second body 106 through the opening 112 in the first end 108.

In the illustrated example, the cigar hole punch 100 includes a positioning pin 122, which may also be referred to as a column, post, or awl. In some examples, the positioning pin 122 is metal, such as steel and/or aluminum. In other examples, the positioning pin 122 can be constructed of another material. The positioning pin 122 is at least partially disposed in the first body 104. In the position in shown in FIG. 1, the positioning pin 122 is entirely disposed in the first body 104. The positioning pin 122 has a tip 124. In this example, the tip 124 is pointed, and may be referred to as a pointed or sharpened tip 124. The positioning pin 122 is disposed within the cutting blade 118 (e.g., the cutting blade 118 surrounds the positioning pin 122). In this example, the positioning pin 122 is coaxial with the cutting blade 118. In this example, the positioning pin 122 is also aligned with and disposed along the central axis 102. However, in other examples, the positioning pin 122 can be offset from the center of the cutting blade 118 and/or the central axis 102.

The cutting blade 118 and the positioning pin 122 are moveable between a retracted position, which is shown in FIG. 1, and one or more deployed positions. In some examples, in the retracted position shown in FIG. 1, the cutting edge 120 and the pointed tip 124 are aligned with or recessed below the first end 108 of the first body 104. This helps prevent accidental poking when the cigar hole punch 100 is not being used. In FIG. 1, the first body 104 is in a first rotational position relative to the second body 106, which corresponds to the retracted position of the cutting blade 118 and the positioning pin 122. The first body 104 can be rotated to other rotational positions to move the cutting blade 118 and the positioning pin 122, as disclosed in further detail herein.

Figure 2:
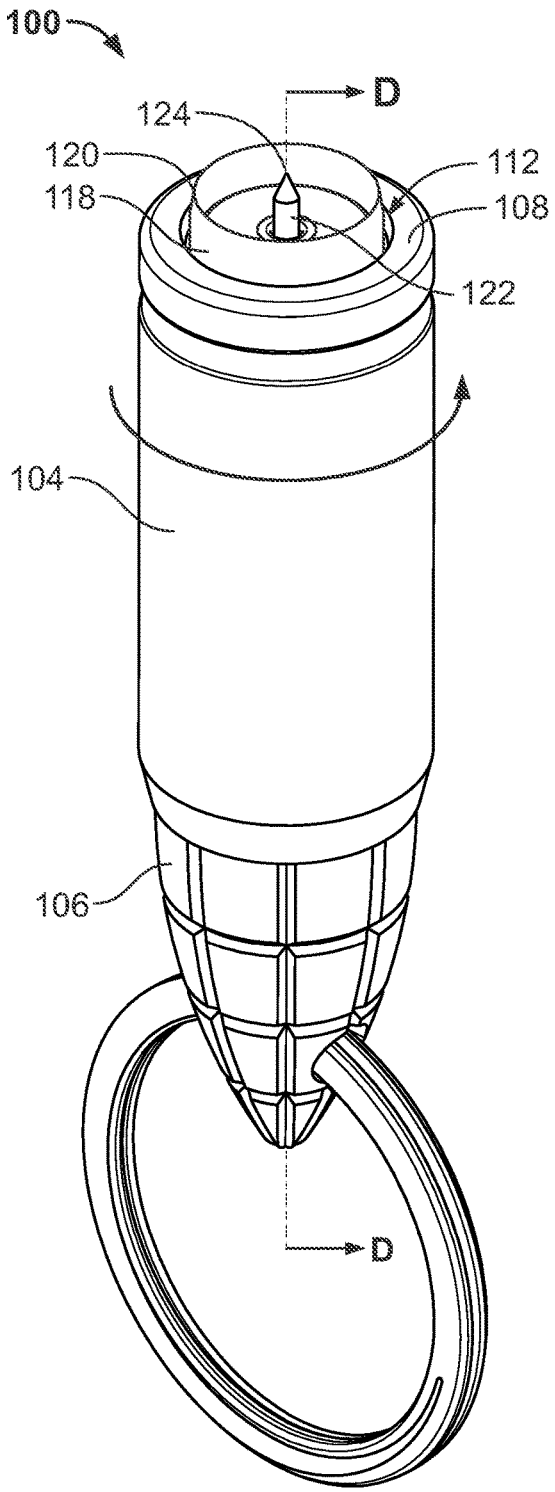
FIG. 2 is a perspective view of the example cigar hole punch of FIG. 1 showing the example cutting blade and the example positioning pin in a first deployed position.

FIG. 2 is a perspective view of the example cigar hole punch 100 in which the cutting blade 118 and the positioning pin 122 have been moved to a first deployed position. As shown in FIG. 2, the cutting blade 118 and the positioning pin 122 have been moved outward or extended from the first end 108 of the first body 104. In this first deployed position, a user can use the cigar hole punch 100 to cut and/or punch a hole in a smoking implement. For example, a user can move the cigar hole punch 100 toward an end of a cigar, such that that the pointed tip 124 engages the end of the cigar first. The user may then further push and/or twist the cigar hole punch 100 so that the cutting edge 120 cuts a hole in the end of the cigar. The cutting blade 118 can be pushed into the cigar until the end of the cigar engages the first end 108 of the first body 104. In some examples, the first deployed position corresponds to a standard depth for a hole. The cigar hole punch 100 can be pulled away from the cigar to remove the material that has been cut, thereby leaving a hole in the end of the cigar.

The cutting blade 118 and the positioning pin 122 can be extended or retracted in response to relative rotation of the first and second bodies 104, 106. For example, the second body 106 can be held stationary and the first body 104 can be rotated or twisted relative to the second body 106. The cigar hole punch 100 includes an actuation mechanism (disclosed in further detail herein) that moves the cutting blade 118 and the positioning pin 122 into and out of the opening 112 in response to relative movement (e.g., rotation) between the first and second bodies 104, 106. In some examples, when the first body 104 is rotated in one direction relative to the first body 104, the cutting blade 118 and the positioning pin 122 are move outward (e.g., extended) from the opening 112 in the first end 108 of the first body 104, and when the first body 104 is rotated in the other direction relative to the second body 106, the cutting blade 118 and the positioning pin 122 are moved back (e.g., retracted) into the opening 112 in the first end 108 of the first body 104. For example, as shown by the arrow in FIG. 2, the first body 104 has been rotated in the clockwise direction relative to the second body 106. In the illustrated example, the first body 104 has been rotated about 180° to a second rotational position relative to the second body 106 that corresponds to the first deployed position of the cutting blade 118 and the positioning pin 122. In some examples, when the first body 104 reaches the second rotational position, the actuation mechanism provides an increased frictional force that holds the first body 104 relative the second body 106. This signals to the user the cutting blade 118 is in the first deployed position. This also prevents the first body 104 from being further rotated (in either direction), until a sufficient amount of twisting force is applied. However, it is understood that the first body 104 can be rotated any amount, such that the cutting blade 118 and the positioning pin 122 can be deployed or extended any amount between the retracted position shown in FIG. 1 and the first deployed position shown in FIG. 2. Therefore, the user can control the depth of the cutting blade 118 to achieve a desired depth of a hole to cut in the cigar.

Figure 3:
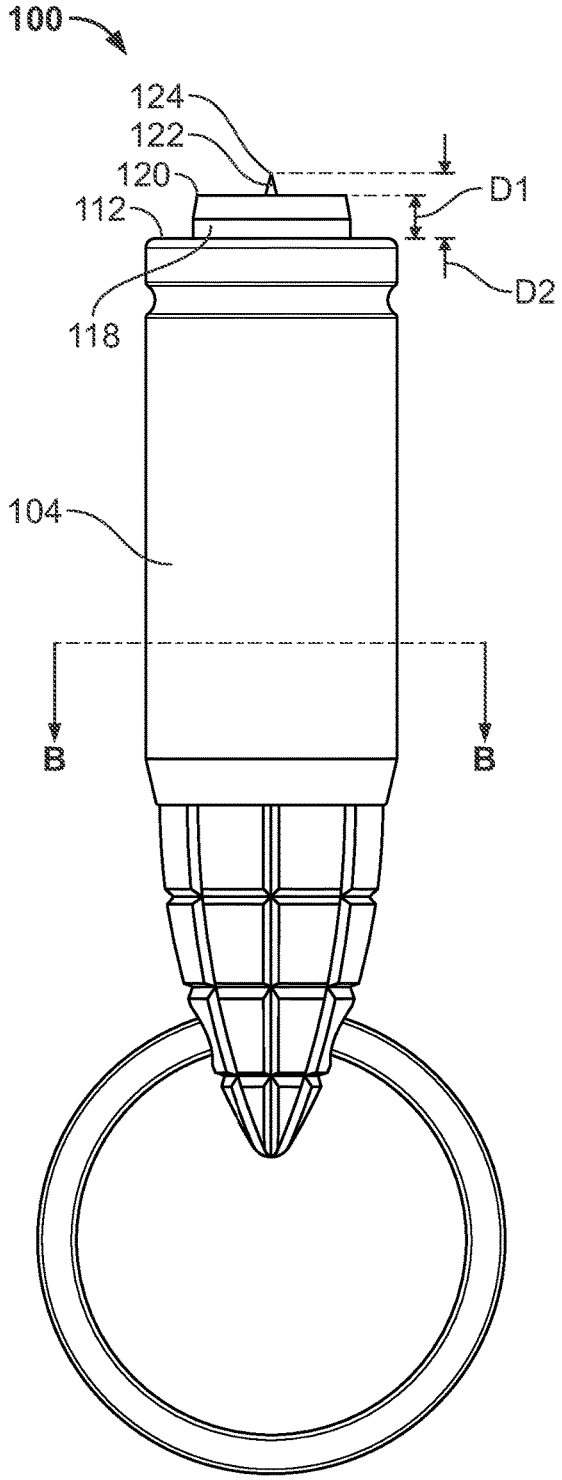
FIG. 3 is a side view of the example cigar hole punch of FIG. 2.

FIG. 3 is a side view of the example cigar hole punch 100 with the cutting blade 118 and the positioning pin 122 in the first deployed position. As shown in FIG. 3, the cutting blade 118 has moved a first distance D1, such that the cutting edge 120 is the first distance D1 from the first end 108 of the first body 104. Further, the positioning pin 122 has moved a second distance D2, such that the pointed tip 124 the positioning pin 122 is a second distance D2 from the first end 108 of the first body 104. The second distance D2 is greater than the first distance D1. In some examples, the tip 124 of the positioning pin 122 extends 2 millimeters (mm) beyond the cutting edge 120 of the cutting blade 120 in this first deployed position. In other examples, the tip 124 can be further from or closer to the cutting edge 120 in this first deployed position. As such, the pointed tip 124 of the positioning pin 122 extends further outward from the first end 108 than the cutting edge 120 of the cutting blade 118. This enables the positioning pin 122 to engage the end of the cigar first, before the cutting edge 120 of the cutting blade 118. As a result, the positioning pin 122 helps to center the cigar hole punch 100 in the desired position on the end of the cigar before pushing the cutting edge 120 into the cigar to cut/punch the hole. The positioning pin 122 helps guide the cutting blade 118 toward the cigar and, thus, prevents or limits side-to-side movement for a cleaner cut. The positioning pin 122 also creates a smaller, but deeper hole in the cigar, which provides more airflow for a better draw.

In this example, the cutting blade 118 and the positioning pin 122 move simultaneously when being moved between the retracted position (FIG. 1) and the first deployed position (FIGS. 2 and 3). In other words, when the first body 104 is rotated relative to the second body 106, the cutting blade 118 and the positioning pin 122 are moved simultaneously. However, the positioning pin 122 moves faster than the cutting blade 118 relative to the first body 104. In particular, the positioning pin 122 has a faster linear rate of movement than the cutting blade 118. For example, rotating the first body 104 relative to the second body 106 causes the cutting blade 118 to move at a first linear speed (per unit of rotation of the first body 104) relative to the first body 104, and the positioning pin 122 to move at a second linear speed (per unit of rotation of the first body 104) relative to the first body 104. The second linear speed is greater than the first linear speed. This enables the tip 124 to be aligned with the cutting edge 120 and the first end 108 in the retracted position, but then move beyond the cutting edge 120 when moved to the first deployed position.

Figure 4:
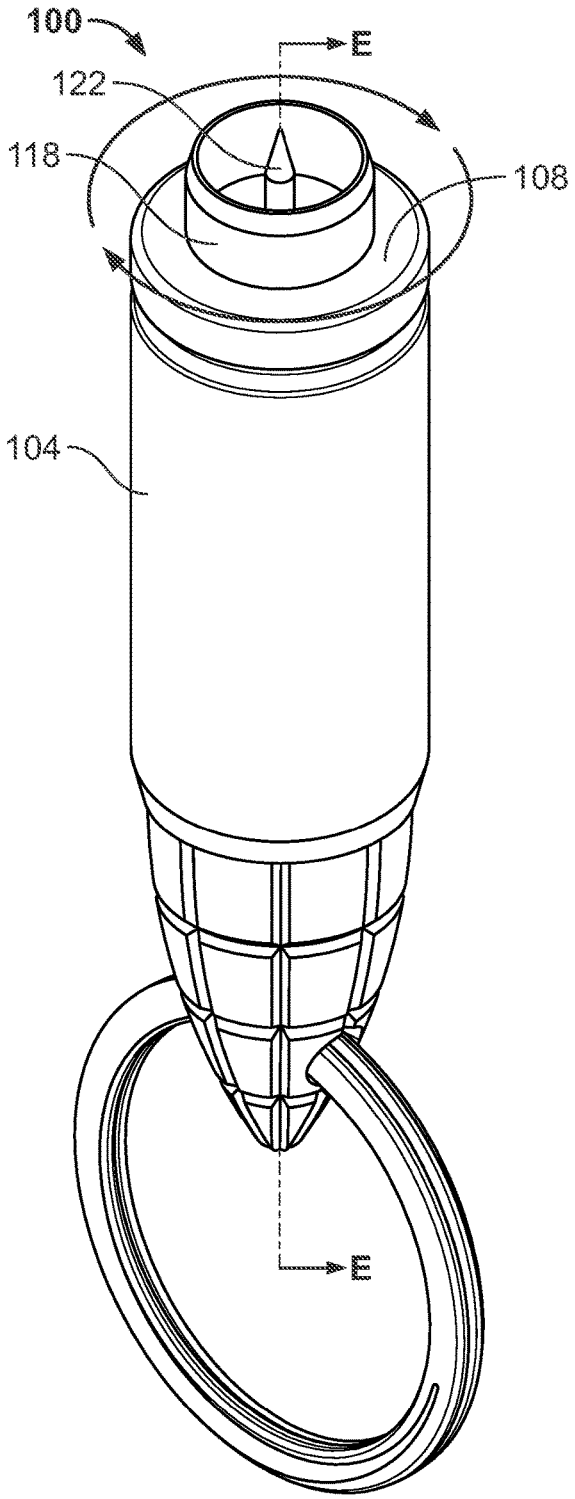
FIG. 4 is a perspective view of the example cigar hole punch of FIG. 1 showing the example cutting blade and the example positioning pin in a second deployed position.

In some examples, the cutting blade 118 and the positioning pin 122 can be moved or extended even further to a second deployed position. FIG. 4 shows the cutting blade 118 and the positioning pin 122 in the second deployed position. This second deployed position also corresponds to the fully deployed position. For example, if the first body 104 is rotated further in the clockwise direction from the second rotational position (FIG. 2) to a third rotational position shown in FIG. 4, the actuation mechanism further extends or moves the cutting blade 118 and the positioning pin 122 from the first end 108 of the first body 104. This enables the cutting blade 118 to make a deeper cut and/or punch into the cigar. In some examples, the third rotational position is 180° from the second rotational position (shown in FIG. 2). Therefore, in this example, the first body 104 has rotated about 360° from the position shown in FIG. 1 to the position shown in FIG. 4. In some examples, when the first body 104 reaches the third rotational position shown in FIG. 4, the actuation mechanism prevents the first body 104 from being further rotated in the clockwise direction and, thus, prevents the cutting blade 118 and the positioning pin 122 from being further extended. In some examples, the actuation mechanism also provides a small amount of friction to prevent the first body 104 from being rotated back in the counter-clockwise direction. This helps hold the cutting blade 118 and the positioning pin 122 in the second deployed position, until a sufficient amount of force is applied.

Figure 5:
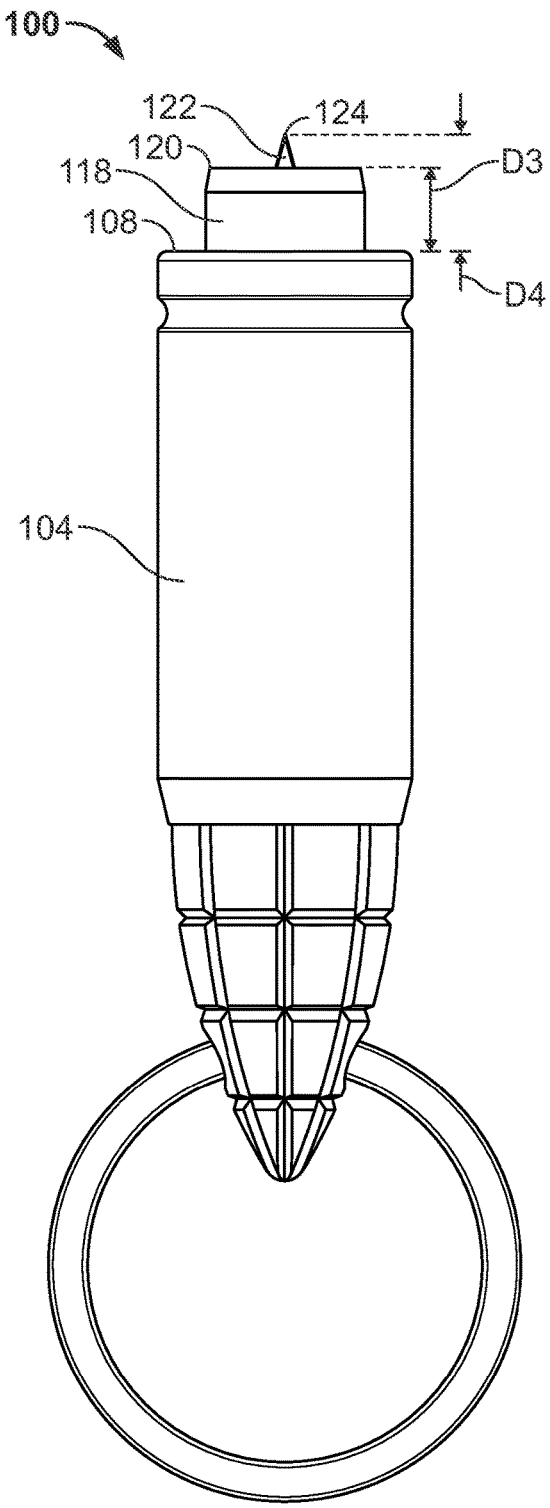
FIG. 5 is a side view of the example cigar hole punch of FIG. 4.

FIG. 5 is a side view of the example cigar hole punch 100 with the cutting blade 118 and the positioning pin 122 in the second deployed position. In this example, the second deployed position corresponds to the fully deployed position. In other examples, there may be more than two deployed positions. As shown in FIG. 5, the cutting blade 118 has moved a third distance D3 (from the reacted position), such that the cutting edge 120 is the third distance D3 from the first end 108 of the first body 104. Further, the positioning pin 122 has moved a fourth distance D4 (from the retracted position), such that the pointed tip 124 the positioning pin 122 is the second distance D4 from the first end 108 of the first body 104. The fourth distance D4 is greater than the third distance D4. In some examples, the tip 124 of the positioning pin 122 extends 4 millimeters (mm) beyond the cutting edge 120 of the cutting blade 120 in this second deployed position. In other examples, the tip 124 can be further from or closer to the cutting edge 120 in the second deployed position. Further, a first difference between the fourth distance D4 and the third distance D3 is greater than a second difference between the second distance D2 and the first distance D1. In other words, the pointed tip 124 is extended further outward relative to the cutting edge 120 in the second deployed position (FIGS. 4 and 5) than in the first deployed position (FIGS. 2 and 3).

To retract the cutting blade 118 and the positioning pin 122, the first body 104 can be rotated in the opposite (e.g., counter-clockwise direction), which causes the cutting blade 118 and the positioning pin 122 to move back into the first end 108 of the first body 104. In some examples, when the cutting blade 118 and the positioning pin 122 reach the first deployed position (FIGS. 2 and 3), the actuation mechanism creates a small amount of additional friction to indicate the cutting blade 118 and the positioning pin 122 are in the first deployed position. The user can then further twist the first body 104 in the counter-clockwise direction to continue retracting the cutting blade 118 and the positioning pin 122 back to the retracted position.

Figure 6:
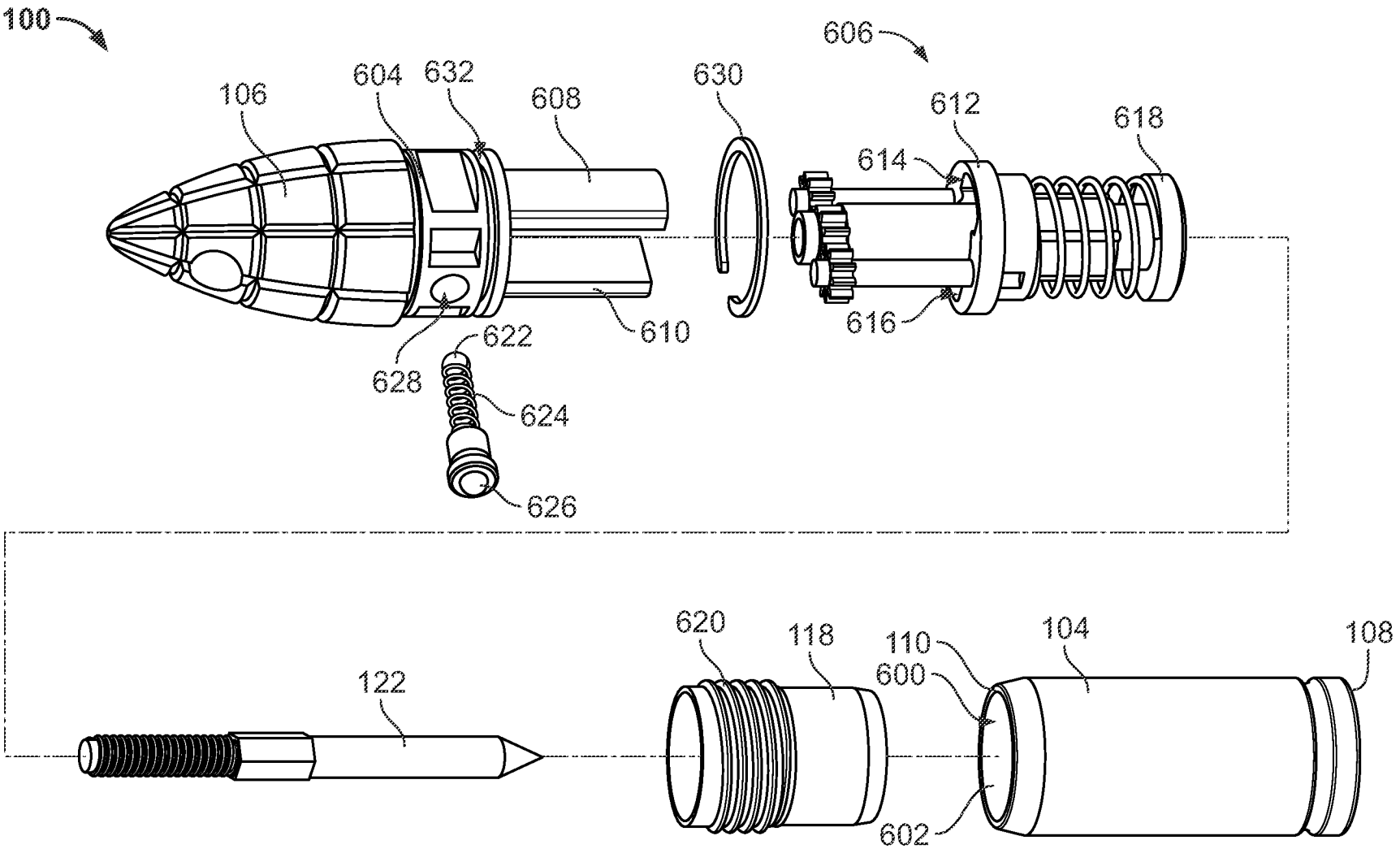
FIG. 6 is a partially exploded view of the example cigar hole punch of FIG. 1.

FIG. 6 is a partially exploded view of the example cigar hole punch 100. The key ring 114 is not shown in FIG. 6. In the illustrated example, the cigar hole punch 100 includes the first body 104, the second body 106, the cutting blade 118, and the positioning pin 122. The first body 104 is cylindrical and defines a passage or channel 600 between the first end 108 and the second end 110. When the cigar hole punch 100 is assembled, a portion of the second body 106 extends into the channel 600 in the second end 110 of the second body 106. As disclosed above, the first and second bodies 104, 106 can rotate or twist relative to each other. For example, an inner surface 602 of the first body 104 may slide on an outer surface 604 of the second body 106. However, when assembled, the first and second bodies 104, 106 do not move linearly or axially relative to each other.

In the illustrated example, the cigar hole punch 100 includes an actuator 606, which may also be referred to as an actuation mechanism or gear assembly. When the cigar hole punch 100 is assembled, the actuator 606 is disposed in the first body 104 (e.g., in the channel 600). Upon relative rotation of the first and second bodies 104, 106, the actuator 606 operates to move the cutting blade 118 and the positioning pin 122 outward or into the first end 108 of the first body 104. When the cigar hole punch 100 is assembled, the actuator 606 is coupled to the second body 106. For example, the second body 106 has a first post 608 and a second post 610. The actuator 606 has a mount 612 with a first recess 614 and a second recess 616 having shapes that corresponds to (e.g., matches, complements, etc.) the first and second posts 608, 610. When the cigar hole punch 100 is assembled, the first and second posts 608, 610 extend into the corresponding recesses 614, 616 in the mount 612. Therefore, the mount 612 is coupled to the second body 106. In some examples, the posts 608, 610 are engaged with the recesses 614, 616 via friction fit. Additionally or alternatively, the posts 608, 610 can be coupled to the mount 612 via other mechanisms, such as for example an adhesive, a fastener (e.g., a screw), etc. The posts 608, 610 are coupled to the mount 612 such that the mount 612 remains in a fixed position relative to the second body 106. In the illustrated example, the actuator 606 includes an end cap 618 that is coupled to an end of the mount 612. When the cigar hole punch 100 is assembled, the end cap 618 is disposed in the opening 112 (FIG. 1) in the first end 108 of the first body 104. In some examples, the end cap 618 is aligned with the first end 108.

As shown in FIG. 6, the cutting blade 118 is cylindrical. In the illustrated example, the cutting blade 118 has first threads 620. When the cigar hole punch 100 is assembled, the first threads 620 engage with threads on the inner surface 602 of the first body 104, as disclosed in further detail herein.

In the illustrated example, the cigar hole punch 100 includes a ball 622, a spring 624, and an end plug 626. The second body 106 includes a channel 628 (e.g., a through-hole) that extends through the first body 104. When the cigar hole punch 100 is assembled, the ball 622, the spring 624, and the end plug 626 are disposed in the channel 628. The spring 624 is disposed between the ball 622 and the end plug 626. The end plug 626 fixes the assembly in the channel 628. In some examples, the spring 624 biases the ball 622 and the end plug 626 radially outward and into engagement with the inner surface 602 of the first body 104. The ball 622 and the end plug 626 can engage a notch or detent on the inner surface 602 of the first body 104, as shown in further detail herein. In other examples, the end plug 626 remains fixed in the channel 628, and only the ball 622 is moveable in the channel 628.

In the illustrated example, the cigar hole punch 100 includes a ring 630. When the cigar hole punch 100 is assembled, the ring 630 is disposed in a groove 632 formed in the outer surface 604 of the second body 106. In some examples, the ring 630 is constructed of an elastic material. The ring 630 may engage the inner surface 602 of the first body 104, which reduces friction between the first and second bodies 104, 106. This enables the first and second bodies 104, 106 to rotate smoothly relative to each other and thereby prolongs the lift of the cigar hole punch 100. Additionally or alternatively, in some examples, the retainer 630 helps secure the first and second bodies 104, 106 to prevent the first and second bodies 104, 106 from being pulled apart in the longitudinal direction.

Figure 7:
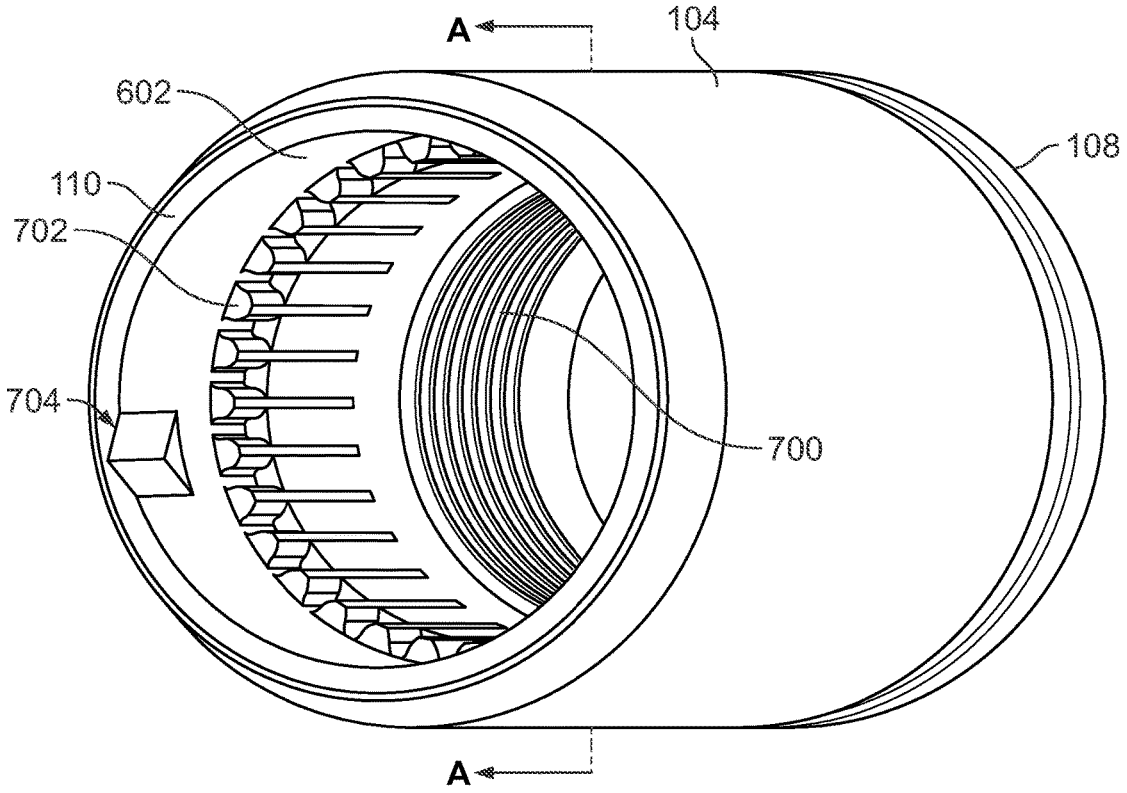
FIG. 7 is a perspective view on an example first body of the example cigar hole punch of FIG. 1.
Figure 8:
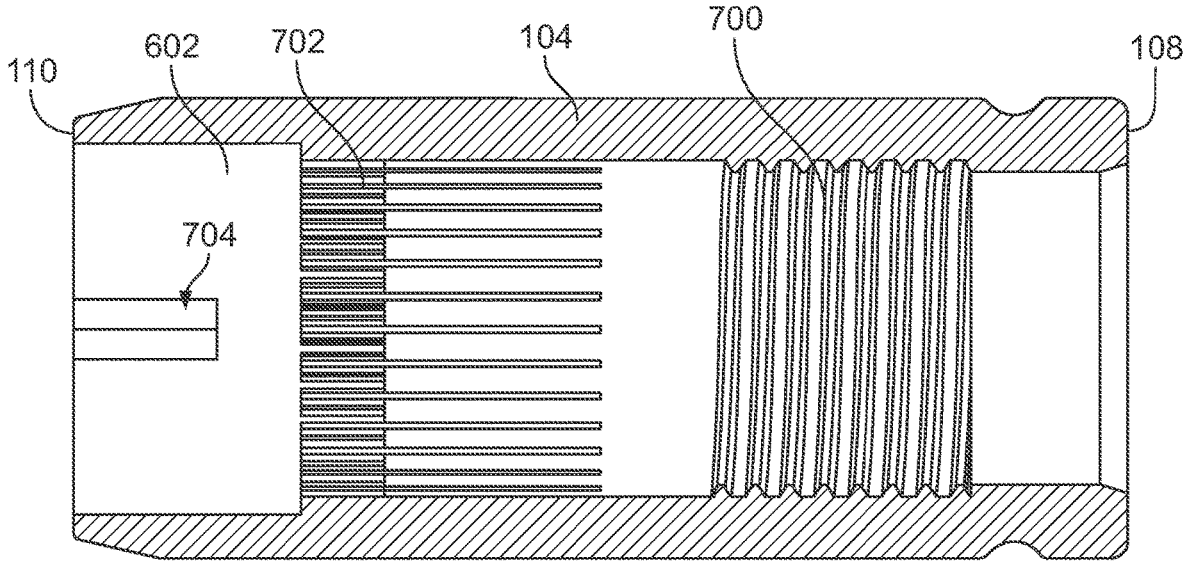
FIG. 8 is a cross-sectional view of the example first body taken along line A-A of FIG. 7.

FIG. 7 is a perspective view of the example first body 104, and FIG. 8 is a cross-sectional view of the example first body 104 taken along line A-A of FIG. 7. As shown in FIGS. 7 and 8, the inner surface 602 of the second body 106 has second threads 700. When the cigar hole punch 100 is assembled, the first threads 620 (FIG. 6) on the cutting blade 118 (FIG. 6) are threadably engaged with the second threads 700 on the inner surface 602 of the first body 104. As such, rotation of the first body 104 causes the cutting blade 118 to move linearly relative to the first body 104. This arrangement provides a smooth and easy manner to deploy or retract the cutting blade 118.

In the illustrated example of FIGS. 7 and 8, the inner surface 602 of the first body 104 has gear teeth 702 around an inner circumference of the first body 104. As disclosed in further detail herein, the gear teeth 702 engage one or more gears of the actuator 606 (FIG. 6) to drive the positioning pin 122 (FIG. 6). In the illustrated example, the second threads 700 are located closer to the first end 108 than the gear teeth 702, and the gear teeth 702 are located closer to the second end 110 than the second threads 700.

In the illustrated example of FIGS. 7 and 8, the inner surface 602 of the second body 106 has a notch 704, which can also be referred to as a detent. The notch 704 is at or near the second end 110 of the first body 104. When the cigar hole punch 100 is assembled, the ball 622 (FIG. 6) and the end plug 626 (FIG. 6) are engaged with and slide or roll along the inner surface 602 of the first body 104. At certain rotational positions of the first body 104 relative to the second body 106, the ball 622 or the end plug 626 may move into the notch 704, which creates a small amount of resistance to further rotational motion. For example, the ball 622 may be engaged with the notch 704 when the first and second bodies 104, 106 are in a first rotational position corresponding to the retracted position (FIG. 1). This creates a small amount of resistance against relative of rotation of the first and second bodies 104, 106. When the user applies a certain amount of twisting force to the first body 104, the first body 104 is rotated relative to the second body 106 and the ball 622 is moved out of the notch 704 and back into the channel 628 (FIG. 6). When the notch 704 reaches the end plug 626 (e.g., after rotating the first body 104 about 180°), the end plug 626 engages the notch 704. This may correspond to the second rotational position of the first and second bodies 104, 106 that corresponds to the first deployed position (FIGS. 2 and 3). The end plug 626 creates a small amount of resistance to hold the first body 104 in this position. The user can apply further twisting force in the same direction to continue to rotate the first body 104, and the end plug 626 is moved out of the notch 704. When the notch 704 reaches the ball 622 again (e.g., after 360° rotation), the ball 622 is moved into the notch 704 again. This may correspond to the third rotational position of the first body 104 that corresponds to the second deployed position (FIGS. 4 and 5). In some examples, the third rotational position is the limit position, and the first body 104 cannot be further rotated. However, the user can rotate the first body 104 back in the opposite direction to retract the cutting blade 118 and the positioning pin 122. Therefore, in this example, the cigar hole punch 100 has one intermediate deployed position between the retracted position and the fully deployed position. In other examples, the cigar hole punch 100 can have more predefined positions. For example, the inner surface 602 of the first body 104 may have two or more notches that correspond to other intermediate deployed positions. However, in other examples, the cigar hole punch 100 may not have any predefined positions. Instead, the user can actuate the cutting blade 118 and the positioning pin 122 to any depth between the retracted position and the fully extended position. The friction between the various parts of the cigar hole punch 100 sufficiently holds the cutting blade 118 and the positioning pin 122 at the deployed depth.

Figure 9:
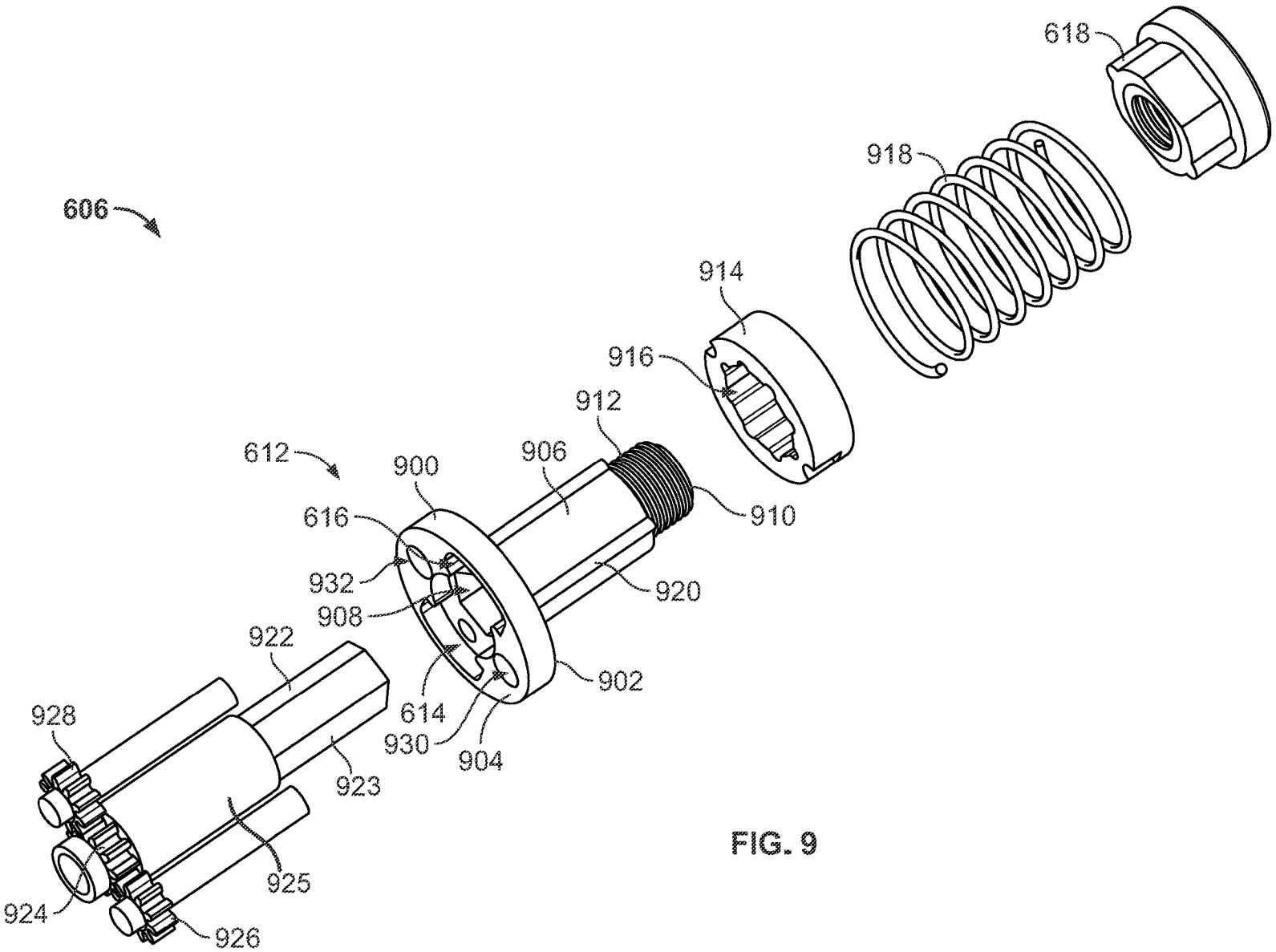
FIG. 9 is an exploded view of an example actuator of the example cigar hole punch of FIG. 1.

FIG. 9 is an exploded view of the example actuator 606. The actuator 606 includes the mount 612. In the illustrated example, the mount 612 includes a flange or disc 900 having a first side 902 and a second side 904. The first and second recesses 614, 616 are formed in the second side 904. The mount 612 also includes a shaft sleeve 906 extending from the first side 902 of the disc 900. The disc 900 and the shaft sleeve 906 may be constructed as a single unitary part or component (e.g., a monolithic structure). The mount 612 has a central opening 908 extending through the disc 900 and the shaft sleeve 906. The actuator 606 includes the end cap 618. When the actuator 606 is assembled, the end cap 618 is coupled to an end 910 of the shaft sleeve 906. In this example, the shaft sleeve 906 has threads 912 at or near the end 910. The end cap 618 can be threadably coupled to the end 910 of the shaft sleeve 906.

In the illustrated example, the actuator 606 includes a slider 914 with an opening 916. When the actuator 606 is assembled, the slider 914 is disposed on the shaft sleeve 906 and is slidable or moveable linearly along the shaft sleeve 906. The actuator 606 also includes a spring 918. When the actuator 606 is assembled, the spring 918 is disposed on the shaft sleeve 906 between the slider 914 and the end cap 618. In some examples, the spring 918 is coupled at its ends to the slider 914 and the end cap 618. The slider 914 can slide along the shaft sleeve 906, which compresses or expands the spring 918. When the cigar hole punch 100 is assembled, the cutting blade 118 (FIG. 6) is coupled to the slider 914 such that the cutting blade 118 and the slider 914 are moveable along the shaft sleeve 906. In some examples, the spring 918 absorbs shocks or impacts when the cutting blade 118 (FIG. 1) is pushed into the cigar. Additionally or alternatively, in some examples, the spring 918 helps to avoid falling off of the cutting blade 118.

The shaft sleeve 906 and the slider 914 have a keying feature that prevents the slider 914 from rotating relative to the shaft sleeve 906. For example, in the illustrated example, the shaft sleeve 906 has a plurality of ribs 920 (one of which is referenced in FIG. 9). The opening 916 of the slider 914 has a shape that corresponds to (e.g., matches, complements, etc.) the outer surface of the shaft sleeve 906 and the ribs 920 and, thus, is keyed to the shaft sleeve 906. This prevents the slider 914 from rotating relative to the shaft sleeve 906. Therefore, the ribs 920 prevent the cutting blade 118 from rotating on the shaft sleeve 906. This enables the cutting blade 118 to move linearly along the shaft sleeve 906, but not rotate relative to the shaft sleeve 906.

As shown in FIG. 9, the actuator 606 includes a guide shaft 922, which may also be referred to as a connecting sleeve. When the actuator 606 is assembled, the guide shaft 922 is disposed in the central opening 908 of the mount 612 and coupled to the mount 612 (e.g., via friction fit, via an adhesive, etc.). In the illustrated example, the guide shaft 922 (or at least a portion of the guide shaft 922) has a hexagonal cross-sectional shape. This corresponds to (e.g., matches, complements, etc.) the shape of the central opening 908 of the mount 612, which prevents relative rotation between the guide shaft 922 and the mount 612. The guide shaft 922 has a central opening (shown in further detail) through which the positioning pin 122 extends.

In the illustrated example, the actuator 606 includes a sun gear 924 that is rotatably coupled to the guide shaft 922. In the illustrated example, the guide shaft 922 has a first portion 923 (a hexagonal section) and second portion 925 (a cylindrical section). The first and second portions 923, 925 may be fixedly coupled or formed integrally. When the actuator 606 is assembled, the first portion 923 is inserted into the central opening 908, and the second portion 925 extends outward from the second side 904 of the disc 900. In some examples, the sun gear 924 is rotatably coupled to the second portion 925. In other examples, the sun gear 924 is formed integral with the second portion 925, and the second portion 925 (along with the sun gear 924) is rotatably coupled to the first portion 923. The sun gear 924 has a central opening that is threaded (shown in further detail herein). When the cigar hole punch 100 is assembled, the sun gear 924 is aligned with can rotate about the central axis 102 (FIG. 1) of the cigar hole punch 100. In the illustrated example, the actuator 606 also includes a first planetary gear 926 and a second planetary gear 928. The sun gear 924 is disposed between and engaged with the planetary gears 926, 928. When the actuator 606 is assembled, the planetary gears 926, 928 are rotatably coupled to the second side 904 of the disc 900. For example, the second side 904 of the disc 900 has a first bore 930 for a bearing and/or shaft of the first planetary gear 926 and a second bore 932 for a bearing and/or shaft of the second planetary gear 928. The planetary gears 926, 928 rotate about axes that are parallel to and offset from the sun gear 924.

Figure 10:
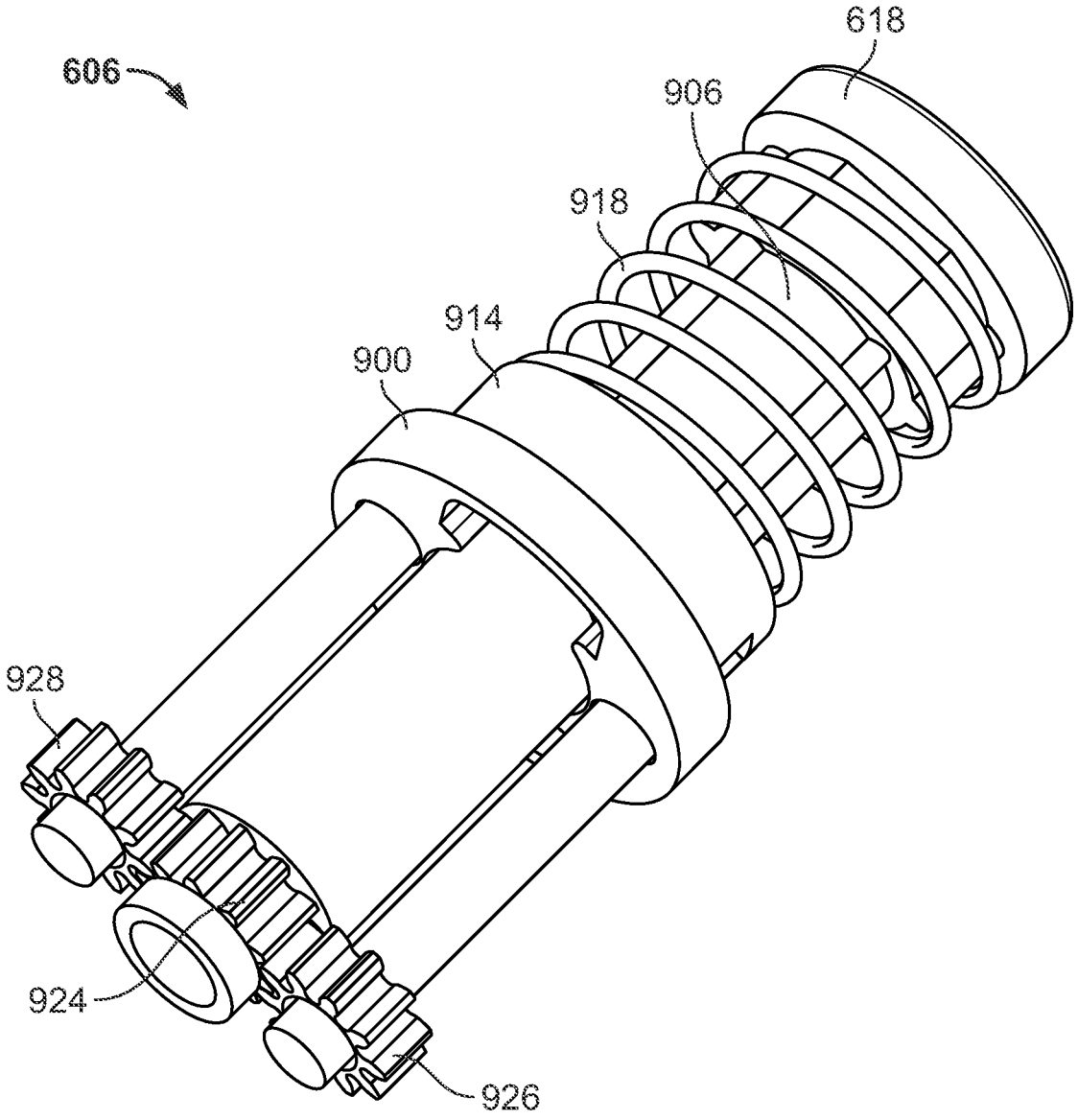
FIGS. 10 and 11 are perspective views of the example actuator of FIG. 9 in an assembled state.
Figure 11:
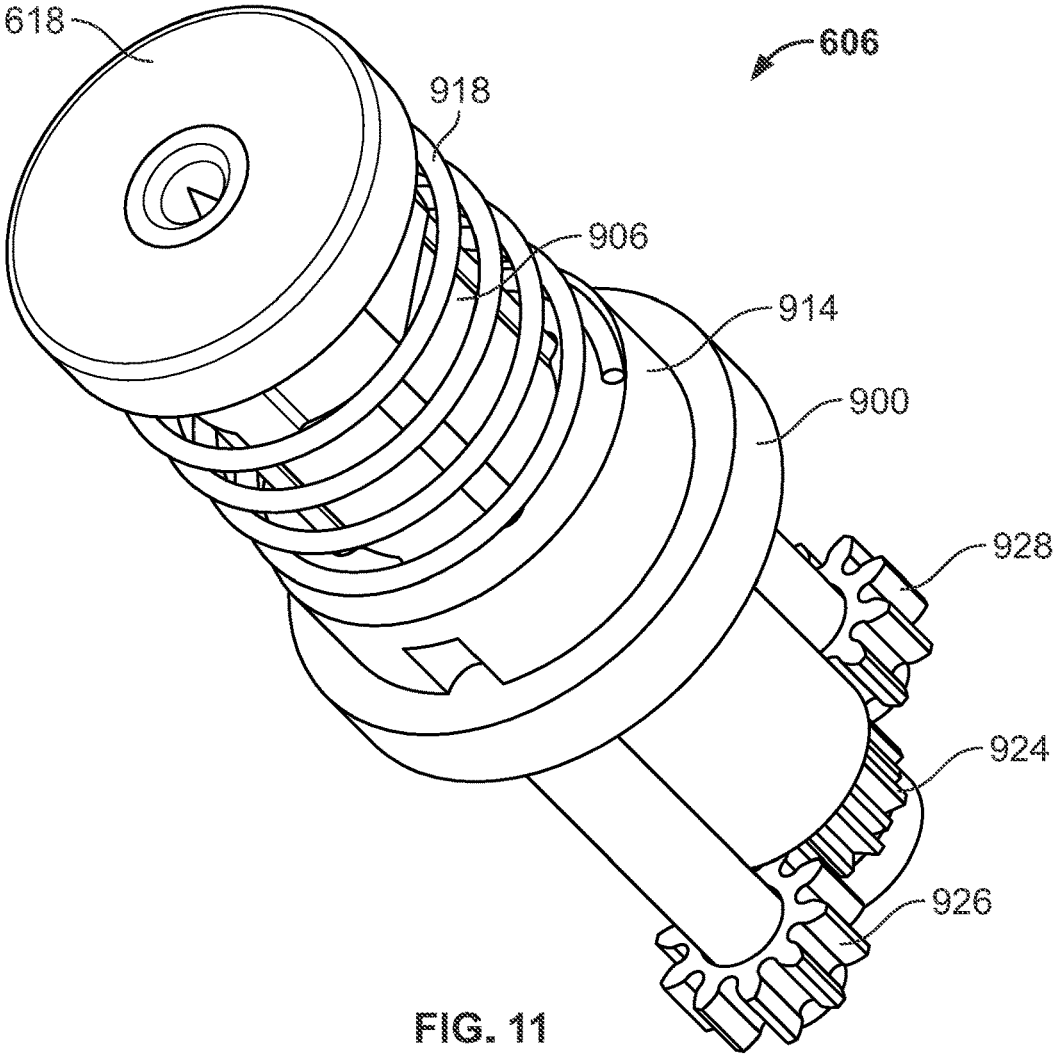

FIGS. 10 and 11 are perspective view of the actuator 606. As shown in FIGS. 10 and 11, the end cap 618 is coupled to the shaft sleeve 906. The slider 914 and the spring 918 are disposed on the shaft sleeve 906. The sun gear 924 and the planetary gears 926, 928 are rotatably coupled to the disc 900.

Figure 12:
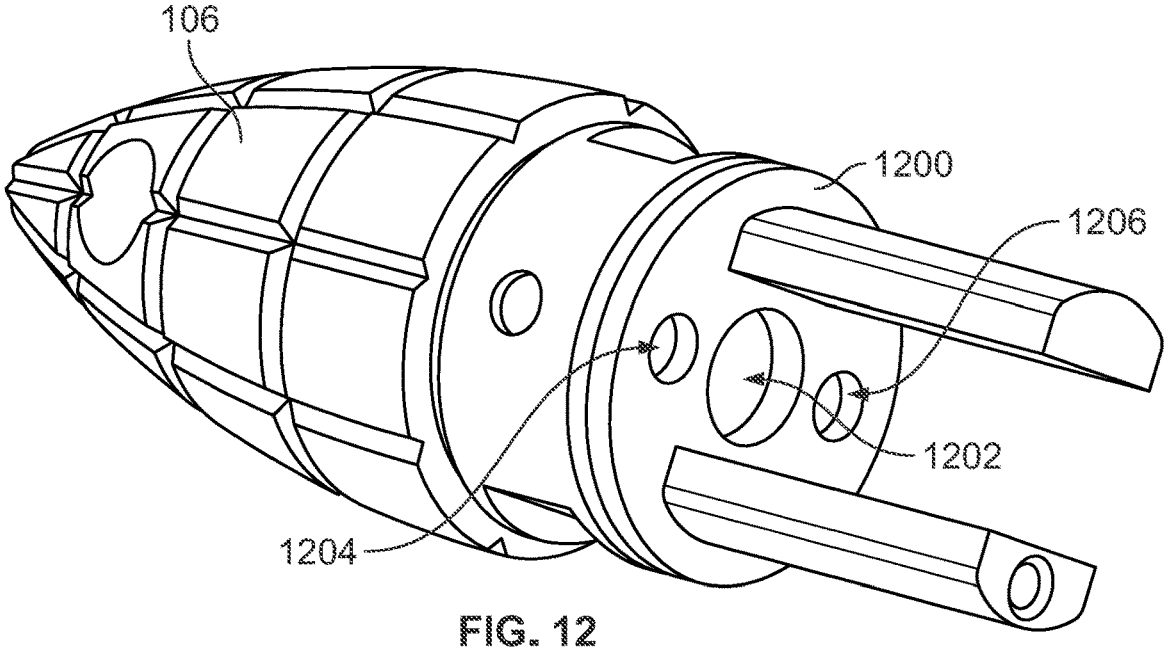
FIG. 12 is a perspective view of an example second body of the example cigar hole punch of FIG. 1.

FIG. 12 is a perspective view of the second body 106. The second body 106 has a surface 1200. The surface 1200 has a central bore 1202. When the cigar hole punch 100 is assembled, a shaft and/or bearing of the sun gear 924 (FIGS. 9-11) extends into the central bore 1202 to enable the sun gear 924 to rotate smooth relative to the second body 106. Similarly, the surface 1200 also has first and second bores 1204, 1206 for shafts and/or bearings of the first and second planetary gears 926, 928, which enable the first and second planetary gears 926, 928 to rotate smoothly relative to the second body 106.

Figure 13:
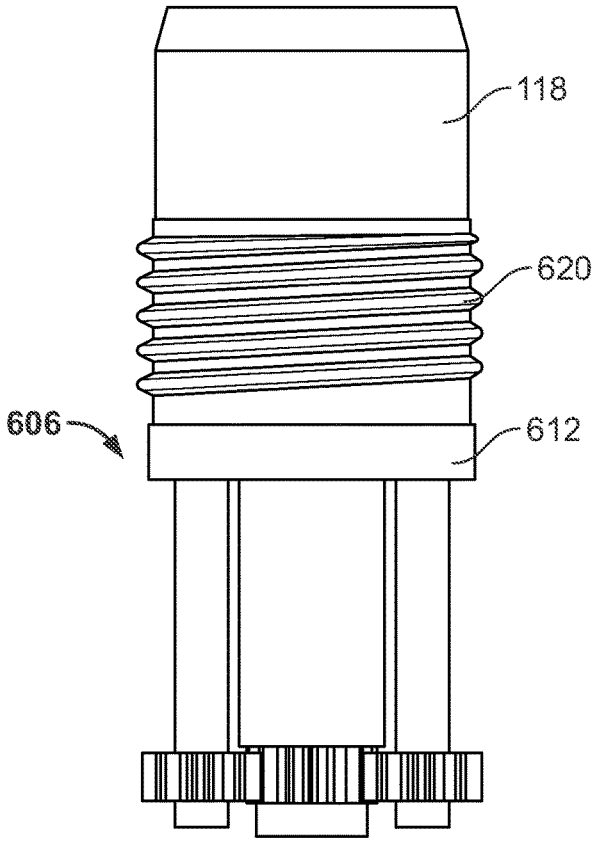
FIG. 13 is a side view of the example cutting blade in a retracted position on the example actuator of FIGS. 10 and 11.
Figure 14:
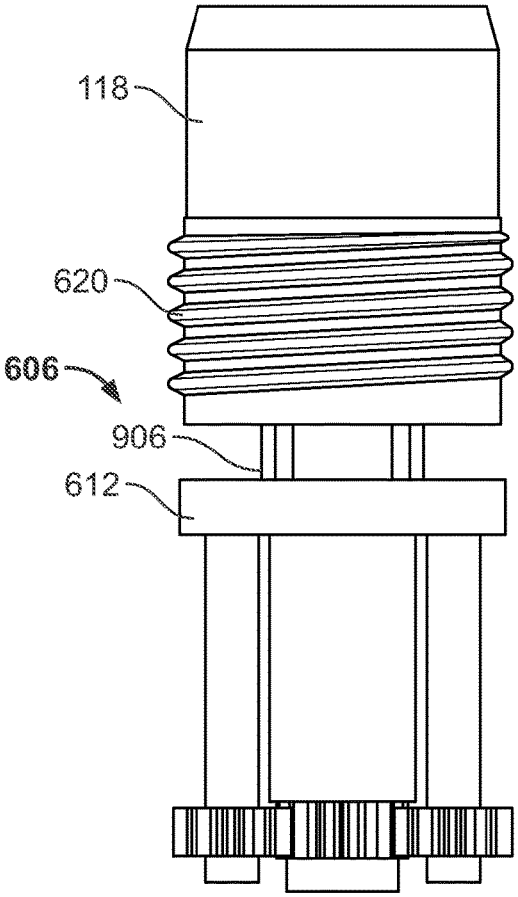
FIG. 14 shows the example cutting blade of FIG. 13 in a deployed position.

FIGS. 13 and 14 shows the actuator 606 and the cutting blade 118. The cutting blade 118 is disposed over the shaft sleeve 906 and coupled (e.g., fixedly coupled) the slider 914 (FIG. 9). When the cigar hole punch 100 is assembled, the first threads 620 on the cutting blade 118 are engaged with the second threads 700 (FIG. 7) on the inner surface 602 (FIG. 7) of the first body 104 (FIG. 7). As disclosed above, the cutting blade 118 cannot rotate relative to the mount 612. Therefore, when the first body 104 is rotated in one direction relative to the second body 106 (and, thus, relative to the mount 612), the threaded engagement causes the cutting blade 118 and the slider 914 to move linearly upward along the shaft sleeve 906, as shown in FIG. 14. This action causes the cutting blade 118 to move from the retracted position to one of the deployed positions. Conversely, when the first body 104 is rotated in the opposite direction, the threaded engagement causes the cutting blade 118 and the slider 914 to move back to the position shown in FIG. 13.

Figure 15:
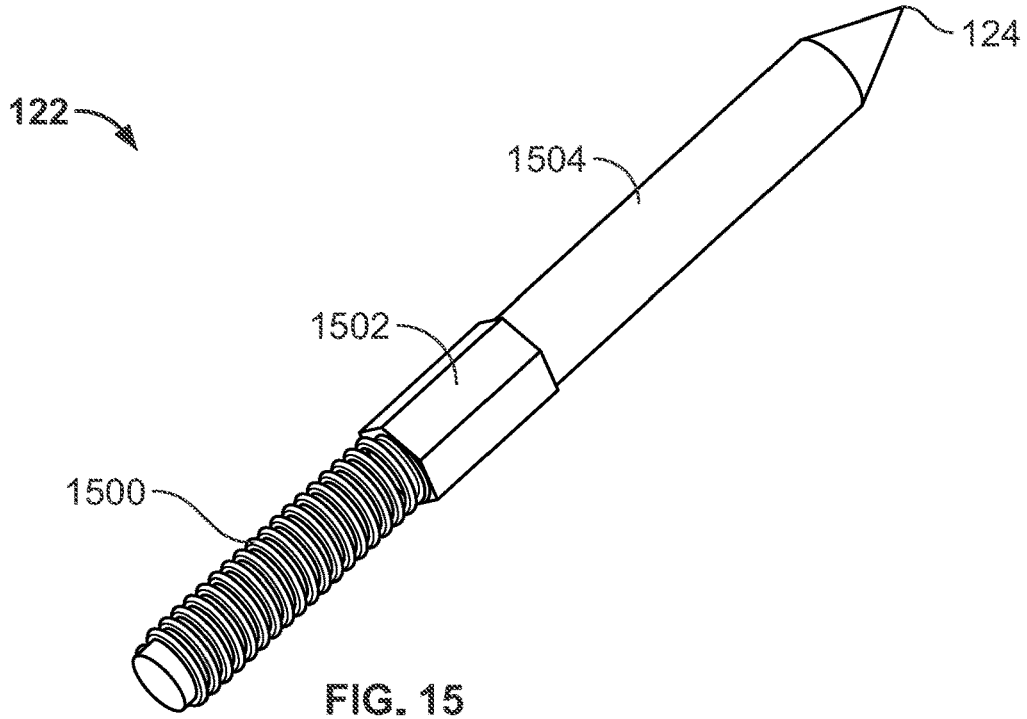
FIG. 15 is a perspective view of the example positioning pin of the example cigar hole punch of FIG. 1.

FIG. 15 is a perspective view of the example positioning pin 122. The positioning pin 122 has a threaded section 1500, a keyed section 1502, and a cylindrical section 1504 that extends to the tip 124. In the illustrated example, the tip 124 is conical. However, in other examples, the tip 124 may not be pointed or conical. Instead, the tip 124 may be a flat or blunt end. When the cigar hole punch 100 is assembled, the positioning pin 122 is disposed in the guide shaft 922 (FIG. 9) of the actuator 606 (FIG. 9). In particular, the threaded section 1500 is engaged with the threads in the sun gear 924 (FIG. 9), and the keyed section 150 is disposed in a central opening of the guide shaft 922.

Figure 16:
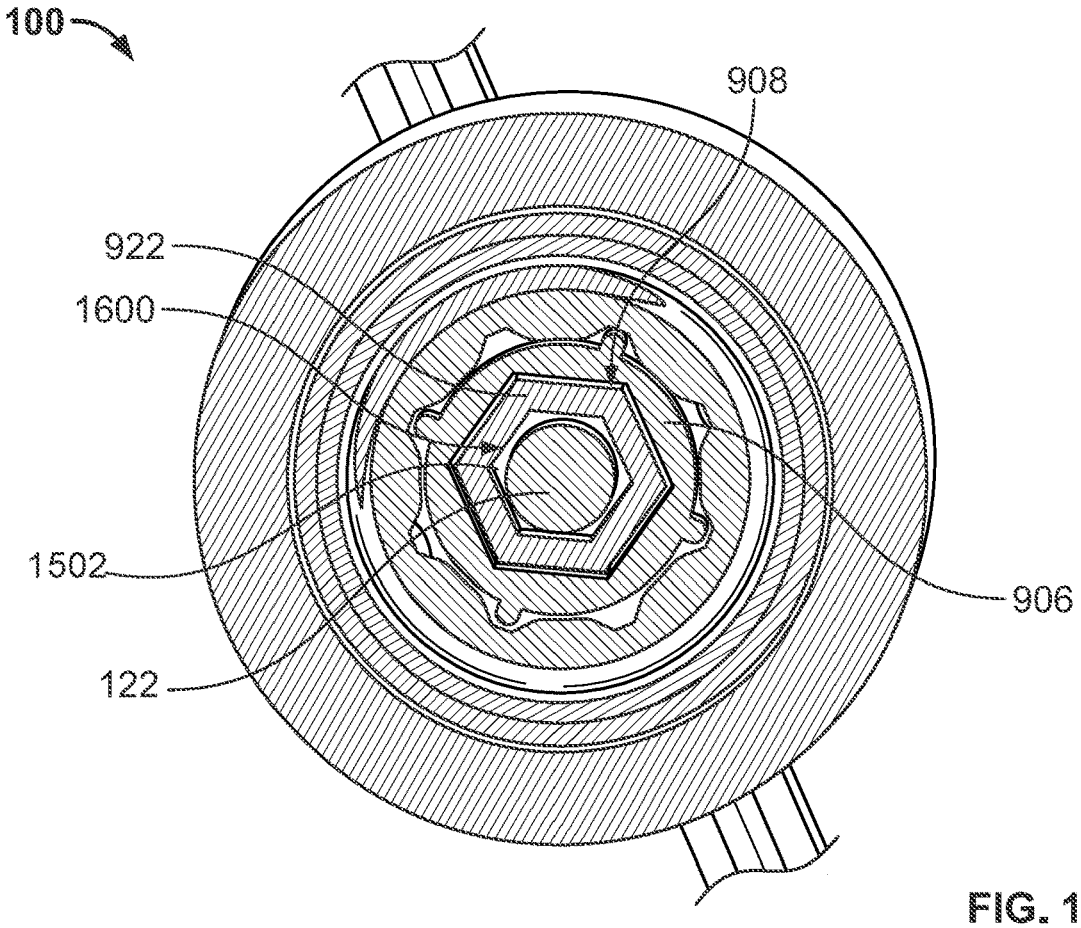
FIG. 16 is a cross-sectional view of the example actuator and the example positioning pin taken along line B-B of FIG. 3.

FIG. 16 is a cross-sectional view of the cigar hole punch 100 taken along line B-B of FIG. 3. As shown in FIG. 16, the guide shaft 922 is disposed in the central opening 908 of the shaft sleeve 906. The guide shaft 922 has a central opening 1600. The positioning pin 122 extends through the central opening 1600. In this example, the central opening 1600 has a hexagonal cross-sectional shape. The keyed section 1502 of the positioning pin 122 has a cross-sectional shape that corresponds to (e.g., matches, complements, etc.) the cross-sectional shape of the central opening 1600. This prevents the positioning pin 122 from rotating relative to the guide shaft 922. Therefore, when the sun gear 924 (FIG. 9) is rotated, the positioning pin 122 is moved linearly upward or downward in the central opening 1600, but does not rotate relative to the guide shaft 922. This action enables the relative rotation of the first and second bodies 104, 106 to the extend or retract the positioning pin 122.

Figure 17:
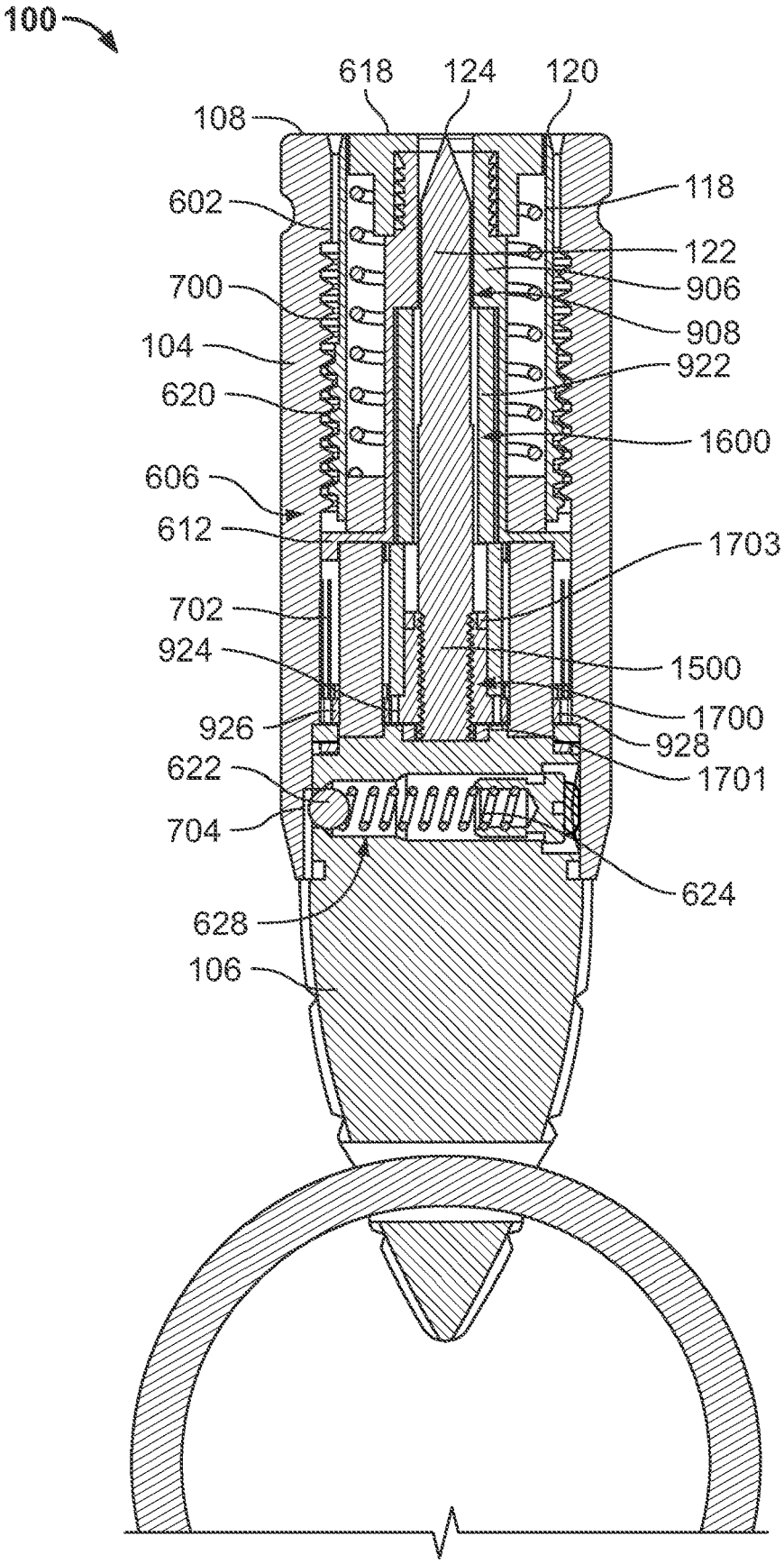
FIG. 17 is a cross-sectional view of the example cigar hole punch of FIG. 1 taken along line C-C of FIG. 1, in which the example cutting blade and the example positioning pin are in the retracted position.

FIG. 17 is a cross-sectional view of the example cigar hole punch 100 taken along line C-C in FIG. 1. In FIG. 17, the first body 104 is in the first rotational position relative to the second body 106, and the cutting blade 118 and the positioning pin 122 are in the retracted position. This position corresponds to the position shown in FIG. 1. The cutting blade 118 and the positioning pin 122 are coaxial with the first and second bodies 104, 106. In the illustrated example, the cap 618 of the actuator 606 is substantially flush or even with the first end 108 of the first body 104. As such, the cigar hole punch 100 has a substantially smooth or flat end. In the illustrated example, the cutting edge 120 of the cutting blade 118 and the pointed tip 124 of the positioning pin 122 are aligned with or recessed relative to the first end 108 and the cap 618. This reduces or prevents a user from accidently poking themselves or someone else.

In the illustrated example, the first threads 620 on the cutting blade 118 are threadably engaged with the second threads 700 on the inner surface 602 of the first body 104. Further, the first and second planetary gears 926, 928 are engaged with the gear teeth 702 on the inner surface 602 of the first body 104. This arrangement forms a planetary gear system. In particular, the first body 104 with the gear teeth 702 corresponds to a ring gear, the first and second planetary gears 926, 928 correspond to planetary gears, the mount 612 corresponds to a carrier of the planetary gears, and the sun gear 924 corresponds to a sun gear. The positioning pin 122 is disposed in the central openings 908, 1600 of the shaft sleeve 906 and the guide shaft 922. The threaded section 1500 of the positioning pin 122 is disposed in a threaded opening 1700 in the sun gear 924. As shown in FIG. 17, a first bearing 1701 is provided at one end of the sun gear 924 and a second bearing 1703 is provided at the opposite end of the sun gear 924. The first bearing 1701 can be disposed in the central bore 1202 (FIG. 12), and the second bearing 1703 can be disposed in the guide shaft 922. The bearings 1701, 1703 enable the sun gear 924 to rotate smoothly relative to the second body 106 and the mount 612 of the actuator 606.

In the position shown in FIG. 17, the ball 622 is engaged with the notch 704 on the inner surface 602 of the first body 104. The spring 624 biases the ball 622 outward and into the notch 704, which provides a small amount of resistance to maintain the first and second bodies in the position shown in FIG. 17. When a sufficient amount of twisting force is applied to the first body 104, the ball 622 is pushed back into the channel 628 and the first body 104 can rotate with less resistance relative to the second body 106.

Figure 18:
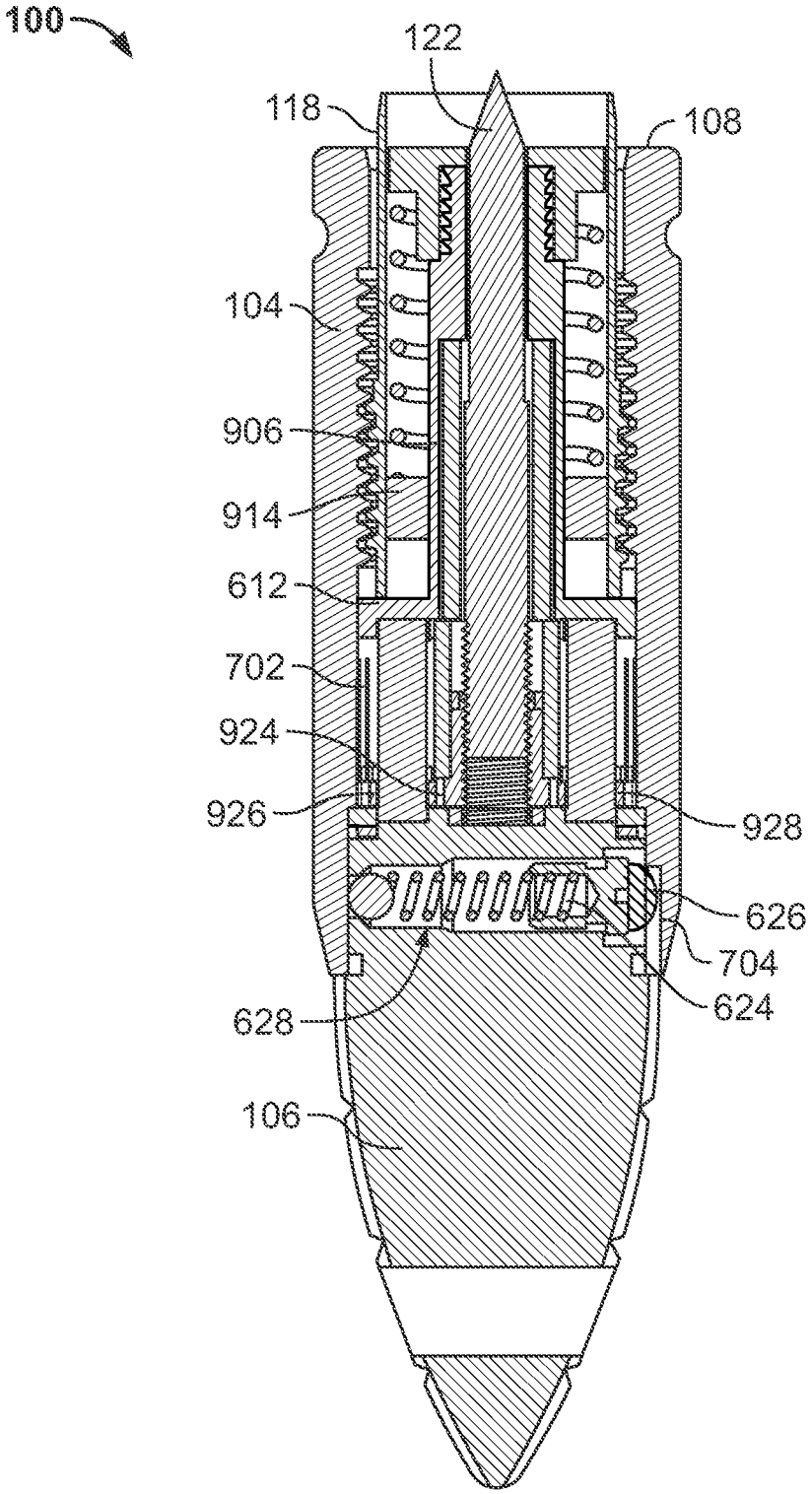
FIG. 18 is a cross-sectional view of the example cigar hole punch of FIG. 1 taken along line D-D of FIG. 2, in which the example cutting blade and the example positioning pin are in the first deployed position.

FIG. 18 shows cigar hole punch 100 after the first body 104 has been rotated about 180° relative to the second body 106 to the second rotational position. As shown in FIG. 18, the cutting blade 118 and the positioning pin 122 have been moved (e.g., extended) outward from the first end 108 of the first body 104 to the first deployed position. This position corresponds to the first deployed position also shown in FIGS. 2 and 3. FIG. 18 is a cross-sectional view taken along line D-D of FIG. 2. The key ring 114 (FIG. 1) is not shown in FIG. 18.

The mount 612 is fixed relative to the second body 106. The cutting blade 118 and the slider 914 can move (e.g., slide) linearly along the shaft sleeve 906, but cannot rotate relative to the shaft sleeve 906. Therefore, when the first body 104 is rotated relative to the second body 106, the threaded engagement between the cutting blade 118 and the first body 104 causes the cutting blade 118 to move upward to the position in FIG. 18.

Further, the sun gear 924 and the first and second planetary gears 926, 928 remain in the same location relative to the second body 106. The sun gear 924 and the planetary gears 926, 928 only rotate about their respective axes. When the first body 104 is rotated relative to the second body 106, the gear teeth 702 rotate the planetary gears 926, 928, which rotate the sun gear 924. As disclosed above, the positioning pin 122 is restricted from rotating relative the mount 612. Therefore, when the sun gear 924 is rotated, the threaded engagement between the sun gear 924 and the positioning pin 122 causes the positioning pin 122 to move upward to the position in FIG. 18. Therefore, relative rotation of the first and second bodies 104, 106 causes the first and second planetary gears 926, 928 to rotate the sun gear 924 to move the positioning pin 122 linearly relative to the first body 104.

In the position shown in FIG. 18, the end plug 626 is engaged with the notch 704. The spring 624 biases the end plug 626 outward and into the notch 704, which provides a small amount of resistance to main the first and second bodies 104, 106 in the position shown in FIG. 18 and, thus, maintains the cutting blade 118 and the positioning pin 122 in the first deployed position. When a sufficient amount of twisting force is applied to the first body 104, the end plug 626 is pushed back into the channel 628, and the first body 104 can rotate with less resistance relative to the second body 106.

Figure 19:
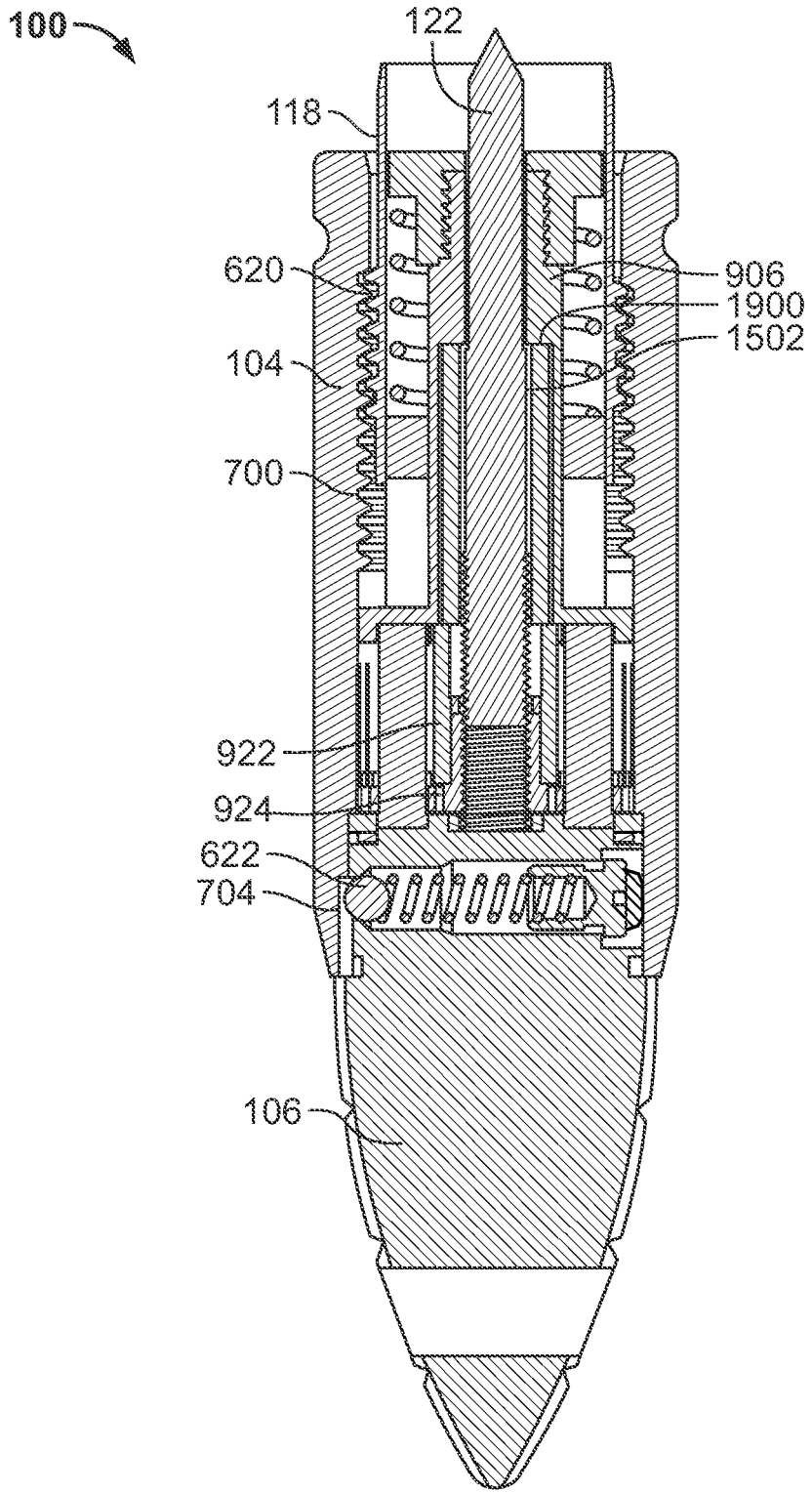
FIG. 19 is a cross-sectional view of the example cigar hole punch of FIG. 1 taken along line E-E of FIG. 4, in which the example cutting blade and the example positioning pin are in the second deployed position.

FIG. 19 shows cigar hole punch 100 after the first body 104 has been rotated about another 180° relative to the second body 106 to the third rotational position. As shown in FIG. 19, the cutting blade 118 and the positioning pin 122 have been moved further outward to the second deployed position. This position corresponds to the second deployed position also shown in FIGS. 4 and 5. FIG. 19 is a cross-sectional view taken along line E-E of FIG. 4. The key ring 114 (FIG. 1) is not shown in FIG. 19.

As shown in FIG. 19, the cutting blade 118 has been driven further upward by rotating the first body 104 relative to the second body 106. Further, the positioning pin 122 has been driven further upward by the rotating sun gear 924. In the position shown in FIG. 19, the ball 622 is in the notch 704 again (similar to FIG. 17). The ball 622 provides a small amount of resistance to hold the first and second bodies 104, 106 in this position, until a sufficient force is applied to rotate one or both of the first or second bodies 104, 106.

In some examples, one or more limits or stops are provided to prevent the cutting blade 118 and the positioning pin 122 from being further deployed outward. For example, as shown in FIG. 19, the first threads 620 on the cutting blade 118 have reached the top thread on the second threads 700 of the first body 104. As such, the first body 104 cannot be rotated further in the same direction to further deploy the cutting blade 118 and the positioning pin 122. Further, as shown in FIG. 19, the keyed section 1502 of the positioning pin 122 has engaged a ledge or shoulder 1900 in the shaft sleeve 906. This prevents the positioning pin 122 from being drive further upward. As such, these structures limit the first body 104 from rotating in the same direction relative to the second body 106 and, thus, prevent the cutting blade 118 and the positioning pin 122 from being further deployed.

To move the cutting blade 118 and the positioning pin 122 back to the first deployed position (FIG. 18) or the retracted position (FIG. 17), the first body 104 can be rotated in the reverse direction relative to the second body 106. This causes the opposite effect as disclosed above, and thereby moves the cutting blade 118 and the positioning pin 122 downward and back into the first body 104. When the cutting blade 118 and the positioning pin 122 are in the retracted position, the slider 914 (FIG. 9) is engaged with the disc 900 (FIG. 9). Also, as shown in FIG. 17, the positioning pin 122 is engaged with the second body 106. These limits prevent the first body 104 from being rotated in a direction that moves the cutting blade 118 and the positioning pin 122 further into the first body 104.

Also disclosed herein are example methods of using the example cigar hole punch 100. An example method includes rotating the first body 104 in a first direction (e.g., clockwise) relative to the second body 106 to move the cutting blade 118 and the positioning pin 122 from the retracted position (FIG. 17) to the deployed position (FIG. 18 or 19). In the deployed position, the cigar hole punch 100 can be used to punch or cut a hole in a cigar. The method can also include rotating the first body 104 in a second direction (e.g., counter-clockwise) relative to the second body 106 to move the cutting blade 118 and the positioning pin 122 from the deployed position (FIG. 18 or 19) to the retracted position (FIG. 17). As disclosed above, rotating the first body 104 relative to the second body 106 causes the cutting blade 118 to move at a first linear speed relative to the first body 104 and the positioning pin 122 to move at a second linear speed relative to the first body 104. The second linear speed is greater than the first linear speed.

While some of the examples disclosed herein are described in connection with rotating the first body 104 while holding the second body 106 stationary, the example operations disclosed herein also occur if the first body 104 is held stationary and the second body 106 is rotated relative to the first body 104. For example, if the first body 104 is held stationary, and the second body 106 is rotated relative to the first body 104, the cutting blade 118 and the positioning pin 122 move linearly into and out of the first end 108 of the second body 106 between the retracted position, the first deployed position, and the second deployed position. Additionally, because the second body 106 is rotating, the mount 612 of the actuator 606 also rotates. This causes the cutting blade 118 and the positioning pin 122 to also rotate relative to the first body 104 as the cutting blade 118 and the positioning pin 122 move into or out of the first end 108. In other examples, the first and second bodies 104, 106 can be rotated simultaneously in opposite directions.

As disclosed above, relative rotation of the first and second bodies 104, 106 cause the actuator 606 to move the cutting blade 118 and the positioning pin 122 relative to the first body 104. However, in other examples, other types of relative motion between the first and second bodies 104, 106 can be used to retract or deploy the cutting blade 118 and the positioning pin 122. For example, the cutting blade 118 and the positioning pin 122 may be fixedly coupled to the second body 106, and the first and second bodies 104, 106 may be moveable linearly toward or away from each other. The first and second bodies 104, 106 may be pushed toward each other to expose the cutting blade 118 and the positioning pin 122 outward from the first end 108 of the first body 104. Conversely, the first and second bodies 104, 106 can be moved away from each other to retract the cutting blade 118 and the positioning pin 122 back into the first end 108 of the first body 104.

In other examples, the cigar hole punch 100 can include a slidable trigger that a user can use to move the cutting blade 118 and the positioning pin 122 up and down. Thus, the cigar hole punch 100 can be configured such that other types of relative motion and/or devices can move the cutting blade 118 and the positioning pin 122 relative to the first body 104.

Figure 20:
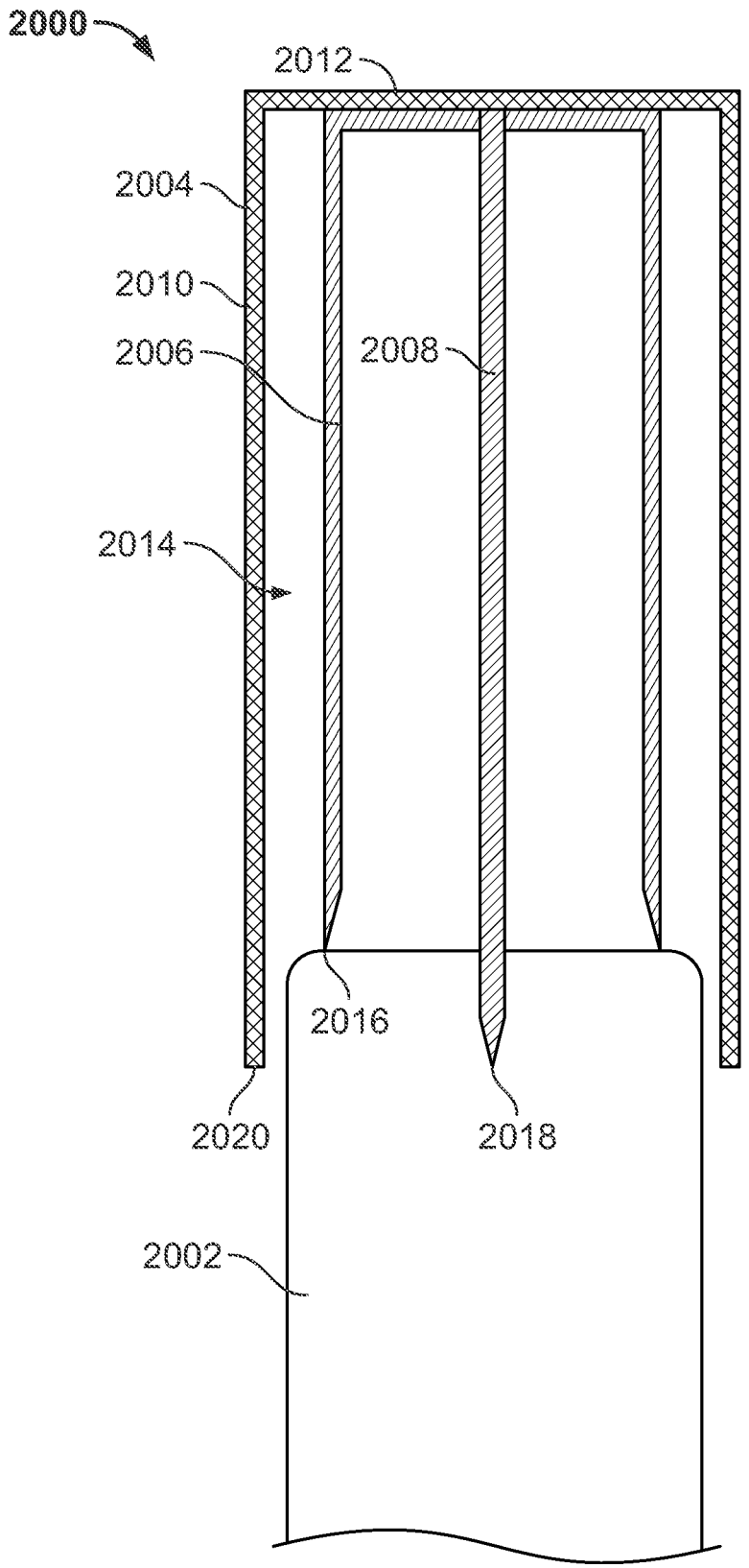
FIG. 20 is cross-sectional view of an example cigar hole punch constructed in accordance with teachings of this disclosure.

FIG. 20 illustrates another example cigar hole punch 2000 constructed in accordance with the teachings of this disclosure. FIG. 20 is a cross-sectional view of the example cigar hole punch 2000. A portion example cigar 2002 is also schematically shown in FIG. 20. The example cigar hole punch includes a casing or body 2004, a circular cutting blade 2006, and a positioning pin 2008. The body 2004 and the cutting blade 2006 may be cylindrical. The cutting blade 2006 and the positioning pin 2008 are coupled to the body 2004. In the illustrated example, the body 2004 has a side wall 2010 and an end wall 2012 defining a cavity 2014. The cutting blade 2006 and the positioning pin 2008 are disposed in the cavity 2014. In some examples, the cutting blade 2006 and the positioning pin 2008 are centered and/or coaxial with the body 2004. In this example the cutting blade 2006 and the positioning pin 2008 are coupled to an extend from the end wall 2012. Further, the positioning pin 2008 is disposed in the cutting blade 2006. In some examples, the positioning pin 2008 is coaxial with the cutting blade 2006.

The cutting blade 2006 has a cutting edge 2016. The positioning pin 2008 has a tip 2018 (e.g., a pointed tip). As shown in FIG. 20, the tip 2018 of the positioning pin 2008 extends outward beyond the cutting edge 2016 of the cutting blade 2006. This enables the positioning pin 2008 to engage the cigar 2002 first before the cutting blade 2006. In the illustrated example, the cutting edge 2016 is recessed relative to an end 2020 of the side wall 2010, and the pointed tip 2018 is aligned or recessed relative to the end 2020 of the side wall 2010. This prevents or reduces accidental poking. Therefore, in this example, the cigar hole punch 2000 does not have any moving or actuating components. Similar to the cigar hole punch 100, the cigar hole punch 2000 can be coupled to a key ring.

In FIG. 20, the cigar hole punch 2000 is being used to cut and/or punch a hole in the cigar 2002. A user can hold the body 2004 with one hand and the cigar 2002 with their other hand. The user can move the cigar hole punch 2000 toward the cigar 2002. As shown in FIG. 20, the positioning pin 2008 has pierced or been inserted into the end of the cigar 2002. This helps provide a smooth and accurate punch and facilitates alignment. The user can then push cigar hole punch 2000 further toward the end of the cigar 2002 and rotate or twist the cigar hole punch 2000 so that the cutting blade 2006 cuts or punches a hole in the cigar 2002. The cutting blade 2006 can be inserted any amount in the cigar 2002 for any desired depth of hole. The user can then pull the cigar hole punch 2000 away from the cigar 2002 to remove the cut material, thereby leaving a hole in the end of the cigar 2002. The example cigar hole punch 2000 can be used with cigars of different diameters.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects and/or things, the phrase "at least one of A and B" is intended to refer to implementations including any of (1) at least one A, (2) at least one B, or (3) at least one A and at least one B. Similarly, as used herein in the context of describing structures, components, items, objects and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements or method actions may be implemented by, e.g., the same entity or object. Additionally, although individual features may be included in different examples or claims, these may possibly be combined, and the inclusion in different examples or claims does not imply that a combination of features is not feasible and/or advantageous.

From the foregoing, it will be appreciated that example cigar hole punches have been disclosed that include a positioning pin to help guide a cutting blade toward an end of a cigar for cutting or punching a cleaner hole. The cutting blade and positioning pin can be fixedly coupled or movably coupled to the body or casing of the cigar hole punch. Example cigar hole punches have been disclosed that can move the cutting blade and positioning pin to a retracted position to prevent accidently poking when not being used to enhance safety. Example cigar hole punches have also been disclosed that provide one or more deployed positions that can create holes of predefined depths for consistency.

Examples and combinations of examples disclosed herein include the following:

Example 1 is a cigar hole punch comprising a first body having an end with an opening, a second body coupled to the first body, a cutting blade at least partially disposed in the first body, a positioning pin at least partially disposed in the first body, and an actuator to move the cutting blade and the positioning pin into and out of the opening in response to relative movement between the first and second bodies.

Example 2 includes the cigar hole punch of Example 1, wherein the relative movement is a relative rotation between the first and second bodies.

Example 3 includes the cigar hole punch of Examples 1 or 2, wherein the actuator is disposed in the first body.

Example 4 includes the cigar hole punch of any of Examples 1-3, wherein, in response to the relative movement between the first and second bodies, the actuator is to move the cutting blade and the positioning pin between (1) a retracted position in which a cutting edge of the cutting blade and a tip of the positioning pin are aligned with or recessed relative to the end of the first body, and (2) a deployed position in which the cutting blade and the positioning pin extend outward from the end of the first body.

Example 5 includes the cigar hole punch of Example 4, wherein, in the deployed position, the cutting edge of the cutting blade is a first distance from the end, and the tip of the positioning pin is a second distance from the end. The second distance is greater than the first distance.

Example 6 includes the cigar hole punch of Examples 4 or 5, further including a ball and a spring disposed in a channel in the second body. The spring is to bias the ball into engagement with an inner surface of the first body. The inner surface of the first body has a notch. The ball is to engage the notch when the first body is in a first rotational position relative to the second body corresponding to the retracted position.

Example 7 includes the cigar hole punch of Example 6, further including an end plug in the channel. The spring is to bias the end plug into engagement with the inner surface of the first body. The end plug is to engage the notch when the first body is in a second rotational position relative to the second body corresponding to the deployed position.

Example 8 includes the cigar hole punch of any of Examples 1-7, wherein, an inner surface of the first body has gear teeth, the actuator includes first and second planetary gears engaged with the gear teeth, the actuator including a sun gear disposed between and engaged with the first and second planetary gears, and the positioning pin has a threaded section disposed in a threaded opening of the sun gear, such that relative rotation of the first and second bodies causes the first and second planetary gears to rotate the sun gear to move the positioning pin linearly relative to the first body.

Example 9 includes the cigar hole punch of Example 8, wherein the actuator includes a mount coupled to the second body. The actuator includes a guide shaft in the mount. The guide shaft has a central opening. The positioning pin extends through the central opening of the guide shaft. The positioning pin has a keyed section with a cross-sectional shape that corresponds to a cross-sectional shape of the central opening to prevent the positioning pin from rotating relative to the guide shaft.

Example 10 includes the cigar hole punch of any of Examples 1-9, wherein the cutting blade has first threads that are threadably engaged with second threads on an inner surface of the first body.

Example 11 includes the cigar hole punch of Example 10, wherein the actuator includes a mount coupled to the second body. The mount includes a shaft sleeve. The actuator includes a slider disposed on the shaft sleeve. The cutting blade is coupled to the slider such that the cutting blade is moveable with the slider along the shaft sleeve.

Example 12 includes the cigar hole punch of Example 11, wherein the shaft sleeve has ribs to prevent the cutting blade from rotating on the shaft sleeve.

Example 13 is a cigar hole punch comprising a body having an end, a circular cutting blade extending from the end of the body, the cutting blade having a cutting edge that is a first distance from the end, and a positioning pin extending from the end of the body. The positioning pin is disposed within the cutting blade. The positioning pin has a tip that is a second distance from the end. The second distance greater than the first distance.

Example 14 includes the cigar hole punch of Example 13, wherein the positioning pin is coaxial with the cutting blade.

Example 15 includes the cigar hole punch of Examples 13 or 14, wherein the tip of the positioning pin is conical.

Example 16 includes the cigar hole punch of any of Examples 12-15, wherein the cutting blade and the positioning pin are moveable relative to the body.

Example 17 includes t cigar hole punch comprising a body, a cutting blade coupled to the body, and a positioning pin coupled to the body. The positioning pin is disposed within the cutting blade. The positioning pin is coaxial with the cutting blade.

Example 18 includes the cigar hole punch of Example 17, wherein a tip of the positioning pin extends outward beyond a cutting edge of the cutting blade.

Example 19 includes the cigar hole punch of Examples 17 or 18, wherein the body has an end wall and a side wall forming a cavity. The cutting blade and the positioning pin are disposed in the cavity.

Example 20 includes the cigar hole punch of Example 19, wherein a tip of the positioning pin is aligned with or recessed relative to an end of the side wall.

Example 21 is a method comprising rotating the first body of the cigar hole punch of claim 1 in a first direction relative to the second body to move the cutting blade and the positioning pin from a retracted position and a deployed position.

Example 22 includes the method of Example 21, further including rotating the first body in a second direction relative to the second body to move the cutting blade and the positioning pin from the deployed position to the retracted position.

Example 23 includes the method of Examples 21 or 22, wherein rotating the first body relative to the second body causes the cutting blade to move at a first linear speed relative to the first body and the positioning pin to move at a second linear speed relative to the first body, the second linear speed greater than the first linear speed.

Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

The following claims are hereby incorporated into this Detailed Description by this reference, with each claim standing on its own as a separate embodiment of the present disclosure.

What is claimed is:

1. A cigar hole punch comprising:

a first body having an end with an opening;

a second body coupled to the first body;

a cutting blade at least partially disposed in the first body;

a positioning pin at least partially disposed in the first body; and an actuator to move the cutting blade and the positioning pin into and out of the opening in response to relative movement between the first and second bodies, wherein the relative movement is a relative rotation between the first and second bodies without linear movement between the first and second bodies.

2. The cigar hole punch of claim 1, wherein the actuator is disposed in the first body.

3. The cigar hole punch of claim 1, wherein, in response to the relative movement between the first and second bodies, the actuator is to move the cutting blade and the positioning pin between (1) a retracted position in which a cutting edge of the cutting blade and a tip of the positioning pin are aligned with or recessed relative to the end of the first body, and (2) a deployed position in which the cutting blade and the positioning pin extend outward from the end of the first body.

4. The cigar hole punch of claim 3, wherein, in the deployed position, the cutting edge of the cutting blade is a first distance from the end, and the tip of the positioning pin is a second distance from the end, the second distance greater than the first distance.

5. A cigar hole punch comprising:

a first body having an end with an opening;

a second body coupled to the first body;

a cutting blade at least partially disposed in the first body;

a positioning pin at least partially disposed in the first body;

an actuator to move the cutting blade and the positioning pin into and out of the opening in response to relative movement between the first and second bodies, wherein, in response to the relative movement between the first and second bodies, the actuator is to move the cutting blade and the positioning pin between (1) a retracted position in which a cutting edge of the cutting blade and a tip of the positioning pin are aligned with or recessed relative to the end of the first body, and (2) a deployed position in which the cutting blade and the positioning pin extend outward from the end of the first body; and a ball and a spring disposed in a channel in the second body, the spring to bias the ball into engagement with an inner surface of the first body, the inner surface of the first body having a notch, the ball to engage the notch when the first body is in a first rotational position relative to the second body corresponding to the retracted position.

6. The cigar hole punch of claim 5, further including an end plug in the channel, the spring to bias the end plug into engagement with the inner surface of the first body, the end plug to engage the notch when the first body is in a second rotational position relative to the second body corresponding to the deployed position.

7. A cigar hole punch comprising:

a first body having an end with an opening, an inner surface of the first body having gear teeth;

a second body coupled to the first body;

a cutting blade at least partially disposed in the first body;

a positioning pin at least partially disposed in the first body; and an actuator to move the cutting blade and the positioning pin into and out of the opening in response to relative movement between the first and second bodies, the actuator including first and second planetary gears engaged with the gear teeth, the actuator including a sun gear disposed between and engaged with the first and second planetary gears, and wherein the positioning pin has a threaded section disposed in a threaded opening of the sun gear, such that relative rotation of the first and second bodies causes the first and second planetary gears to rotate the sun gear to move the positioning pin linearly relative to the first body.

8. The cigar hole punch of claim 7, wherein the actuator includes a mount coupled to the second body, the actuator including a guide shaft in the mount, the guide shaft having a central opening, the positioning pin extending through the central opening of the guide shaft, the positioning pin having a keyed section with a cross-sectional shape that corresponds to a cross-sectional shape of the central opening to prevent the positioning pin from rotating relative to the guide shaft.

9. The cigar hole punch of claim 1, wherein the cutting blade has first threads that are threadably engaged with second threads on an inner surface of the first body.

10. A cigar hole punch comprising:

a first body having an end with an opening;

a second body coupled to the first body;

a cutting blade at least partially disposed in the first body, the cutting blade having first threads that are threadably engaged with second threads on an inner surface of the first body;

a positioning pin at least partially disposed in the first body; and an actuator to move the cutting blade and the positioning pin into and out of the opening in response to relative movement between the first and second bodies, the actuator including a mount coupled to the second body, the mount including a shaft sleeve, the actuator including a slider disposed on the shaft sleeve, the cutting blade coupled to the slider such that the cutting blade is moveable with the slider along the shaft sleeve.

11. The cigar hole punch of claim 10, wherein the shaft sleeve has ribs to prevent the cutting blade from rotating on the shaft sleeve.

12. The cigar hole punch of claim 1, wherein the positioning pin is coaxial with the cutting blade.

13. The cigar hole punch of claim 1, wherein a tip of the positioning pin is conical.

* * * * *